US005654124A

United States Patent [19]

Yamaguchi

[11] Patent Number: 5,654,124

[45] Date of Patent: Aug. 5, 1997

[54] SILVER HALIDE PHOTOGRAPHIC MATERIAL AND PROCESS FOR THE FORMATION OF IMAGE USING SAME

[75] Inventor: Tetsuo Yamaguchi, Kanagawa, Japan

[73] Assignee: Fuji Photo Film Co., Ltd., Kanagawa, Japan

[21] Appl. No.: 467,394

[22] Filed: Jun. 6, 1995

Related U.S. Application Data

[63] Continuation of Ser. No. 171,425, Dec. 22, 1993, abandoned.

[30] Foreign Application Priority Data

Dec. 24, 1992 [JP] Japan ..... 4-357375
Apr. 23, 1993 [JP] Japan ..... 5-119203

[51] Int. Cl.[6] ..... G03C 1/10

[52] U.S. Cl. ..... 430/264; 430/434; 430/588; 430/598; 430/600; 430/603; 430/611

[58] Field of Search ..... 430/264, 434, 430/588, 598, 600, 603, 604, 611, 614

[56] References Cited

U.S. PATENT DOCUMENTS

| | | | |
|---|---|---|---|
| 4,634,660 | 1/1987 | Mifune et al. | 430/614 |
| 5,100,761 | 3/1992 | Yagihara et al. | 430/264 |
| 5,110,719 | 5/1992 | Shuto et al. | 430/598 |
| 5,200,298 | 4/1993 | Takagi et al. | 430/264 |
| 5,213,944 | 5/1993 | Adin | 430/264 |
| 5,213,952 | 5/1993 | Kawashima et al. | 430/598 |
| 5,256,519 | 10/1993 | Adin | 430/264 |
| 5,264,323 | 11/1993 | Purol et al. | 430/264 |
| 5,273,859 | 12/1993 | Katoh et al. | 430/264 |

*Primary Examiner*—Hoa Van Le
*Attorney, Agent, or Firm*—Sughrue, Mion, Zinn, Macpeak & Seas

[57] ABSTRACT

A silver halide photographic material containing at least one silver halide emulsion layer on a support is provided. The silver halide emulsion layer comprises chemically sensitized silver halide grains having a silver chloride content of 50 mol % or more, said silver halide emulsion has been spectrally sensitized with at least one dye selected from the dyes represented by one of the general formulas (1), (2) and (3) shown in the specification. The emulsion layer or at least one other hydrophilic colloidal layer contains at least one member selected from the hydrazine derivatives represented by one of the formulas (4), (5) and (6) shown in the specification and at least one compound selected from the compounds represented by one of the formulas (7), (8), (9), (10), (11) and (12) shown in the specification.

A process for the formation of an image is also provided, which comprises the development of a silver halide photographic material as defined above with a developer having a pH value of 9.6 to less than 11.0.

10 Claims, No Drawings

SILVER HALIDE PHOTOGRAPHIC MATERIAL AND PROCESS FOR THE FORMATION OF IMAGE USING SAME

This is a continuation of application Ser. No. 08/171,425 filed Dec. 22, 1993 abandoned.

FIELD OF THE INVENTION

The present invention relates to a silver halide photographic material. More particularly, the present invention relates to an ultrahigh contrast silver halide photographic material for use in a photomechanical process and to a process for forming an image using that photographic material.

BACKGROUND OF THE INVENTION

In the field of graphic arts, in order to optimize the reproduction of a continuous tone image or line image from a halftone image, an image formation system which exhibits an ultrahigh contrast (particularly γ of 10 or more) is required.

An image formation system which comprises development with a processing solution having an excellent storage stability to obtain a photographic image with an ultrahigh contrast has been desired. As such an image formation system, a process has been proposed which comprises processing a surface latent image type silver halide photographic material comprising a specific acyl hydrazine compound with a developer having a pH value of 11.0 to 12.3 and containing a sulfurous acid preservative in an amount 0.15 mol/l or more to form an ultrahigh contrast with γ of more than 10 as disclosed in U.S. Pat. Nos. 4,166,742, 4,168,977, 4,221,857, 4,224,401, 4,243,739, 4,272,606 and 4,311,781. While the conventional ultrahigh contrast image formation processes can be carried out only with silver bromochloride having a high silver chloride content, this new image formation process is characterized in that silver bromoiodide and silver bromochloroiodide can be used as well. While the conventional lith developers can contain only an extremely small amount of sulfurous acid preservative, this new developer can contain a large amount of sulfurous acid preservative and thus provide a relatively high storage stability.

However, a developer having a pH value of 11 or more is susceptible to air oxidation and thus is too unstable for prolonged storage or use.

In an attempt to form a high contrast image, an approach has been proposed to develop a silver halide photographic material containing a hydrazine compound with a developer having a lower pH value.

JP-A-1-179939 and JP-A-1-179940 (the term "JP-A" as used herein means an "unexamined published Japanese patent application") disclose a processing method which comprises processing of a photographic material containing a nucleating agent having a group to be adsorbed to silver halide grains with a developer having a pH value of 11.0 or less in the presence of a nucleation development accelerator containing a group to be adsorbed to silver halide grains. However, the emulsion used in these inventions comprises silver bromide or silver bromoiodide, which is susceptible to great fluctuation in photographic properties with fluctuations in the progress of development or the composition of the processing solution and thus leaves much to be desired in terms of stability.

U.S. Pat. Nos. 4,998,604, 4,994,365, and 4,975,354 disclose hydrazine compounds having repeating units of ethylene oxide and hydrazine compounds having pyridinium groups. However, the description of examples shows that these inventions leave much to be desired in contrast development and thus can hardly provide a high contrast and a required Dmax under practical development conditions.

Further, a nucleatable hard contrast photographic material comprising a hydrazine derivative is susceptible to great fluctuation in photographic properties with changes in the pH value of the developer. The pH value of the developer shows great fluctuation with changes in the conditions. In other words, the pH value shows a rise due to air oxidation of the developer or the concentration of the developer by the evaporation loss of water or a drop due to the absorption of carbon dioxide in the air. Accordingly, an approach for a smaller dependence of photographic properties on the pH value of the developer has been attempted.

Examples of the use of chemically sensitized silver bromochloride in a hydrazine system are disclosed in JP-A-53-20921, JP-A-60-83028, JP-A-60-140399, JP-A-63-46437, JP-A-63-103230, JP-A-3-294844, JP-A-3-294845, and JP-A-4-174424. On the other hand, examples of the combined use of a hdyrazine and a silver halide emulsion containing a heavy metal complex such as rhodium and iridium are disclosed in JP-A-60-83028, JP-A-61-47942, JP-A-61-47943, JP-A-61-29837, JP-A-62-201233, JP-A-62-235947, and JP-A-63-103232.

Many examples of cyanine dyes having an anionic charge contained in a hydrazine system have been disclosed, including an alkaline salt of 5,5'-dichloro-9-ethyl-3,3'-bis(3-sulfopropyl)oxacarbocyanine. These examples are disclosed in JP-A-61-29837, JP-A-62-235947, JP-A-62-280733, JP-A-62-280734, JP-A-2-40, JP-A-2-124560, JP-A-2-262653, and JP-A-3-63641.

However, the use of chemically sensitized silver bromochloride is disadvantageous in that a photographic material comprising such an emulsion coated thereon shows a rise in sensitivity after prolonged storage and hence a worsened black pepper phenomenon.

The black pepper phenomenon comprises black spots made of minute developed silver grains formed on a portion which would be unexposed and would not form any image. This phenomenon causes a trouble in photomechanical processes.

U.S. Pat. Nos. 4,998,604, 4,994,365, and 4,975,354 disclose hydrazine compounds having repeating units of ethylene oxide and hydrazine compounds having pyridinium groups. However, as is evident from examples, these inventions leave much to be desired in contrast development and thus can hardly provide a high contrast and a required Dmax under practical development conditions.

On the other hand, the use of a hydrazine compound which is active enough to provide a high contrast and a required Dmax is disadvantageous in that it gives a rise in sensitivity after a prolonged storage and hence a worsened black pepper phenomenon.

The incorporation of a mercaptoazole represented by general formula (7) in a silver halide photographic material containing hydrazine is exemplified in JP-A-56-67843, JP-A-58-191245, JP-A-60-83028, JP-A-61-47944, and JP-A-63-103232.

The incorporation of a triazine compound represented by general formula (8) in a silver halide photographic material containing hydrazine is exemplified in JP-A-4-365032.

The incorporation of a dihydroxybenzene represented by general formula (9) in a silver halide photographic material containing hydrazine is exemplified in JP-A-61-233734 and JP-A-1-55549.

The incorporation of a thiosulfonic acid represented by general formula (10), (11) or (12) in a silver halide photographic material containing hydrazine is exemplified in JP-A-1-237538.

SUMMARY OF THE INVENTION

An object of the present invention is to provide a silver halide photographic material which can provide an extremely high contrast of more than 10 as calculated in terms of γ when developed with a stable developer which remains stable for a prolonged period of time.

Another object of the present invention is to provide a silver halide photographic material which provides a high contrast with a developer having a pH value of not more than 11, exhibits a small fluctuation in properties even when processed in a large amount, exhibits little black pepper even when developed with a developer which has been quite oxidized by air, and stays stable for a prolonged period of time.

These and other objects of the present invention will become more apparent from the following detailed description and examples.

The foregoing objects of the present invention are accomplished with a silver halide photographic material comprising at least one silver halide emulsion layer on a support. The silver halide emulsion layer comprises chemically sensitized silver halide grains having a silver chloride content of 50 mol % or more, and the silver halide emulsion of the layer has been spectrally sensitized with at least one dye selected from the group consisting of the dyes represented by one of the following general formulae (1), (2) and (3). The emulsion layer or at least one other hydrophilic colloidal layer contains at least one member selected from the hydrazine derivatives represented by one of the following general formulae (4), (5) and (6) and at least one member selected from the group consisting of the compounds represented by one of the following general formulae (7), (8), (9), (10), (11) and (12):

The compounds represented by one of the general formulae (7), (8), (9), (10) and (12) may be incorporated in the same or different layer, in which at least one of the hydrazine derivatives represented by general formulae (4), (5) and (6),

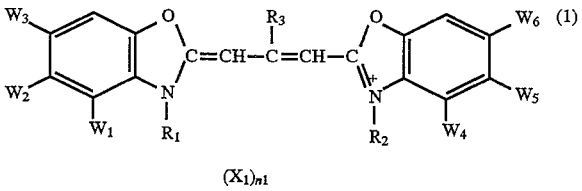

(1)

wherein $W_1$ and $W_4$ each represents a hydrogen atom; $W_3$ and $W_6$ each represents a hydrogen atom, a methyl group or a methoxy group; $W_2$ represents an alkyl group having 1 to 6 carbon atoms which may be branched, an alkoxy group having 1 to 5 carbon atoms, a bromine atom, an iodine atom or an aryl group having 1 to 9 carbon atoms and $W_2$ may be connected to $W_1$ or $W_3$ to form a benzene ring or may also represent a chlorine atom if $W_3$ represents a methyl or methoxy group; $W_5$ represents an alkyl group having 1 to 6 carbon atoms which may be branched, an alkoxy group having 1 to 5 carbon atoms, a halogen atom, a hydroxyl group, an aryl group having 1 to 9 carbon atoms, an aryloxy group having 1 to 9 carbon atoms, an arylthio group having 1 to 8 carbon atoms, an alkylthio group having 1 to 4 carbon atoms or an acylamino group having 1 to 4 carbon atoms and may be connected to $W_4$ or $W_6$ to form a benzene ring; $R_1$ and $R_2$, which may be the same or different, each represents an alkyl or alkenyl group having 1 to 10 carbon atoms which may be substituted; at least one of $R_1$ and $R_2$ is a group containing a sulfo or carboxyl group; $R_3$ represents a lower alkyl group which may be substituted; $X_1$ represents an ion pair necessary for neutralization of electric charge; and $M_1$ represents an integer 0 or 1, with the proviso that if the compound represented by the general formula (1) is an intramolecular salt, $n_1$ is 0;

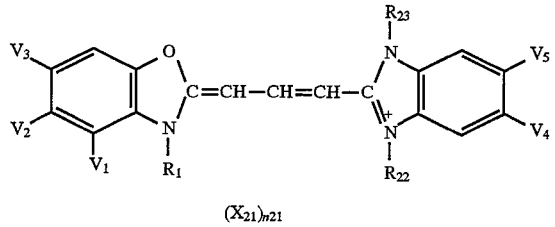

(2)

wherein $V_1$ represents a hydrogen atom; $V_2$ represents a hydrogen atom, a halogen atom, a hydroxyl group, a lower alkyl group which may be branched, a lower alkoxy group, an aryl group having 1 to 9 carbon atoms, an aryloxy group having 1 to 9 carbon atoms, an arylthio group having 1 to 8 carbon atoms, a lower alkylthio group or an acylamino group having 1 to 4 carbon atoms and $V_2$ may be connected to $V_1$ or $V_3$ to form a benzene ring; $V_3$ represents a hydrogen atom, a methyl group or a methoxy group; $V_4$ represents an electron withdrawing group; $V_5$ represents a hydrogen atom, a fluorine atom, a chlorine atom or a bromine atom; $R_{21}$, $R_{22}$ and $R_{23}$, which may be the same or different, each represents an alkyl or alkenyl group having 1 to 10 carbon atoms which may be substituted; at least one of $R_{21}$, $R_{22}$ and $R_{23}$ is a group containing a sulfo or carboxyl group; $X_{21}$ represents an ion pair necessary for neutralization of electric charge; and $n_{21}$ represents an integer 0 or 1, with the proviso that if the compound represented by general formula (2) is an inter salt $n_{21}$ is 0;

| Item | References |
|---|---|
| 1) Nucleation accelerator | Compounds of the general formulae (II), (III), (IV), (V) and (VI) described in Japanese Patent Application No. 4-237366; Compounds of the general formulae (II-m) to (II-p) and (II-1) to (II-22) described in line 13, upper right column, page 9 - line 10, upper left column, page 16 of JP-A-2-103536; compounds as described in JP-A-1-179939 |
| 2) Surface active agent | Line 7, upper right column, page 9 - line 7, lower right column, page 9 of JP-A-2-12236; line 13, lower left column, page 2 - line 18, lower right column page 4 of JP-A-2-18542 |
| 3) Fog Inhibitor | Line 19, lower right column, page 17 - line 4, upper right column, page 18 and line 1–line 5, lower right column, page 18 of JP-A-2-103536; thiosulfinic compounds as described in JP-A-1-237538 |
| 4) Polymer latex | Line 12–line 20, lower left column, page 18 of JP-A-2- |

-continued

| Item | References |
|---|---|
| | 103536 |
| 5) Acid group-containing compound | Line 6, lower right column, page 18 - line 1, upper right column, page 19 of JP-A-2-103536 |
| 6) Mat agent, lubricant, plasticizer | Line 15, upper left column, page 19 - line 15, upper right column, page 19 of JP-A-2-103536 |
| 7) Film hardener | Line 5–line 17, upper right column, page 18 of JP-A-2-103536 |
| 8) Dye | Dyes described in line 1–line 18, lower right column, page 17 of JP-A-2-103536; solid dyes described in JP-A-2-294638 and JP-A-5-11382 |
| 9) Binder | Line 1–line 20, lower right column, page 3 of JP-A-2-18542 |
| 10) Pepper fog inhibitor | Compounds described in U.S. Pat. No. 4,956,257 and JP-A-1-118832 |
| 11) Redox compound | Compounds of general formula (I) (particularly Exemplary Compounds 1 to 50) as described in JP-A-2-301743; Compounds of the general formulae (R-1), (R-2) and (R-3) Exemplary Compounds 1 to 75 described in JP-A-3-174143, pp. 3–20; compounds described in Japanese Patent Application Nos. 3-69466 and 3-15648 |
| 12) Monomethine compound | Compounds of general formula (II) (particularly Exemplary Compounds II-1 to II-26) as described in JP-A-2-287532 |
| 13) Dihydroxybenzenes | Compounds described in JP-A-3-39948, upper left column, page 11 - lower left column, page 12, and EP452772A |

wherein $V_{31}$ and $V_{32}$ each represents a hydrogen atom or the same substituent groups as those specified by $V_4$; $V_{32}$ and $V_{34}$ are the same substituent groups as those specified by $V_4$; $R_{31}$, $R_{32}$, $R_{33}$ and $R_{34}$ may be the same or different and are the same substituent groups as those specified by $R_1$ or $R_2$, in which at least one of $R_{31}$, $R_{32}$, $R_{33}$, and $R_{34}$ represents a group having a sulfo group or a carboxyl group; $X_{31}$ represents an ion pair; and $n_{31}$ represents 0 or 1, with the proviso that if the compound represented by general formula (3) is an intersalt, $n_{31}$ is 0.

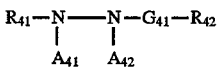

(4)

wherein $R_{41}$ represents an aliphatic or aromatic group containing as a partial structure —O—$(CH_2CH_2O)_n$—, —O—$(CH_2CH(CH_3)O)_n$— or —O—$(CH_2CH(OH)CH_2O)_n$— (in which n represents an integer 3 to 30) or a group containing quaternary ammonium cations as a part of its substituent; $G_{41}$ represents —CO—, —COCO—, —CS—, —C(=$NG_2R_{42}$)—, —SO—, —$SO_2$— or —P(O)($G_{42}R_{42}$)—; $G_{42}$ represents a single bond, —O—, —S— or —N($R_{42}$)—; $R_{42}$ represents an aliphatic group, aromatic group or hydrogen atom, with the proviso that if a plurality of $R_{42}$ groups are present in the molecule, they may be the same or different; and one of $A_{41}$ and $A_{42}$ is a hydrogen atom and the other is a hydrogen atom, acyl group, alkyl group or arylsulfonyl group;

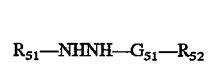

(5)

wherein $R_{51}$ represents an aliphatic, aromatic or heterocyclic group which may be substituted; $G_{51}$ represents —CO—, —$SO_2$—, —SO—, —COCO—, thiocarbonyl group, iminomethylene group or —P(O)($R_{53}$)— (in which $R_{53}$ represents a hydrogen atom, aliphatic group, aromatic group, alkoxy group, aryloxy group or amino group); and $R_{52}$ represents a substituted alkyl group in which a carbon atom bonded to $G_1$ is substituted by at least one electron withdrawing group;

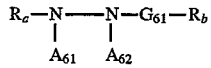

(6)

wherein $A_{61}$ and $A_{62}$ each represents a hydrogen atom or one of $A_{61}$ and $A_{62}$ represents a hydrogen atom and the other represents a sulfinic acid group or an acyl group; $R_a$ represents an aliphatic, aromatic or heterocyclic group; $R_b$ represents a hydrogen atom, an alkyl group, an aryl group, an alkoxy group, an aryloxy group or an amino group; and $G_{61}$ represents a carbonyl group, a sulfonyl group, a sulfoxy group, a phosphoryl group or an iminomethylene group, with the proviso that at least one of $R_a$ and $R_b$ contains a group for accelerating adsorption of the hydrazine derivative to silver halide;

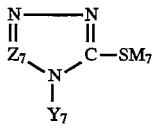

(7)

wherein $Z_7$ represents N or C—$X_7$ (in which $X_7$ represents an alkyl group or an aryl group); $Y_7$ represents an alkyl having a hydrophilic group or an aryl group having a hydrophilic group; and $M_7$ represents a hydrogen atom, metal atom or ammonium;

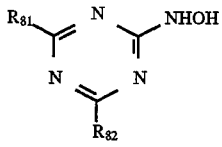

(8)

wherein $R_{81}$ and $R_{82}$, which may be the same or different, each represents a hydroxyl, a hydroxyalkyl, an amino, an alkylamino, an arylamino, an aralkylamino, an alkoxy, a phenoxy, an alkyl, an aryl, an alkylthio or a phenylthio group;

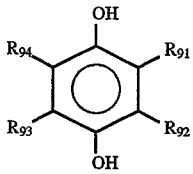

(9)

wherein $R_{91}$, $R_{92}$, $R_{93}$ and $R_{94}$ each represents a hydrogen atom, a hydroxyl group, an alkoxy group, an aryloxy group, an alkylthio group, an arylthio group, a halogen atom, a primary, secondary or tertiary amino group, a carbonamide group, a sulfonamide group, an alkyl group, an aryl group, 5- or 6-membered heterocyclic group containing at least one nitrogen, oxygen or sulfur atom, a forrayl group, a keto group, a sulfonic group, a carboxylic group, an alkylsulfonyl group or an arylsulfonyl group;

(10)

wherein $Z_{10}$ represents an alkyl, an aryl or a heterocyclic group; and $M_{10}$ represents a metal atom or an organic cation;

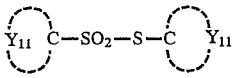

(11)

wherein $Y_{11}$ represents an atomic group necessary for the formation of an aromatic ring or a heterocycle;

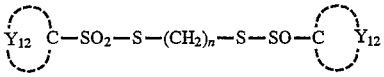

(12)

wherein $Y_{12}$ represents an atomic group necessary for formation of an aromatic ring or heterocycle; and n represents an integer 2 to 10.

DETAILED DESCRIPTION OF THE INVENTION

The sensitizing dye to be used in the present invention is a compound represented by general formula (1), (2) or (3):

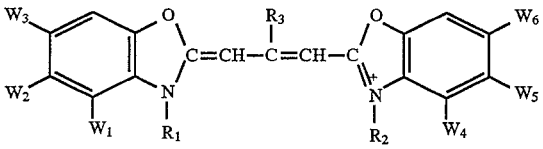

(1)

$(X_1)_{n1}$

In general formula (1), $W_1$ and $W_4$ each represents a hydrogen atom; $W_3$ and $W_5$ each represents a hydrogen atom, a methyl group or a methoxy group. $W_2$ represents an alkyl group having 1 to 6 carbon atoms which may be branched (e.g., methyl, ethyl, butyl, isobutyl, hexyl, methoxyethyl), an alkoxy group having 1 to 5 carbon atoms (e.g., methoxy, ethoxy, pentyloxy, ethoxymethoxy, hydroxyethoxy), a bromine atom, an iodine atom or an aryl group having 1 to 9 carbon atoms (e.g., phenyl, tolyl, anisyl, chlorophenyl, carboxyphenyl) or may be connected to $W_1$ or $W_3$ to form a benzene ring or may represent a chlorine atom if $W_3$ represents a methyl or a methoxy group. $W_5$ represents an alkyl group having 1 to 6 carbon atoms which may be branched (e.g., methyl, ethyl, butyl, isobutyl, hexyl, methoxyethyl), an alkoxy group having 1 to 5 carbon atoms (e.g., methoxy, ethoxy, pentyloxy, ethoxymethoxy, hydroxyethoxy), a hydroxy group, a halogen atom, an aryl group having 1 to 9 carbon atoms (e.g., phenyl, tolyl, anisyl, chlorophenyl, carboxyphenyl), an aryloxy group having 1 to 9 carbon atoms (e.g., tolyloxy, anisyloxy, phenoxy, chlorophenoxy), an arylthio group having 1 to 8 carbon atoms (e.g., tolylthio, chlorophenylthio, phenylthio), an alkylthio group having 1 to 4 carbon atoms (e.g., methylthio, ethylthio, hydroxyethylthio) or an acylamino group having 1 to 4 carbon atoms (e.g., acetylamino, propionylamino, methanesulfonylamino) and may be connected to $W_4$ or $W_6$ to form a benzene ring.

$R_1$ and $R_2$, which may be the same or different, each represents an alkyl or an alkenyl group having 1 to 10 carbon atoms which may be substituted, with the proviso that at least one of $R_1$ and $R_2$ is a group having a sulfo or carboxyl group. Preferred examples of substituents for the alkyl or alkenyl group represented by $R_1$ or $R_2$ include a sulfo group, a carboxyl group, a halogen atom, a hydroxyl group, an alkoxy group having 1 to 6 carbon atoms, an aryl group having 1 to 8 carbon atoms which may be substituted (e.g., phenyl, tolyl, sulfophenyl, carboxyphenyl), a heterocyclic group (e.g., furyl, chenyl), an aryloxy group having 1 to 8 carbon atoms which may be substituted (e.g., chlorophenoxy, phenoxy, sulfophenoxy, hydroxyphenoxy), an acyl group having 1 to 8 carbon atoms (e.g., benzenesulfonyl, methanesulfonyl, acetyl, propionyl), an alkoxycarbonyl group having 1 to 6 carbon atoms (e.g., ethoxycarbonyl, butoxycarbonyl), a cyano group, an alkylthio group having 1 to 6 carbon atoms (e.g., phenylthio, tolylthio), an arylthio group having 1 to 8 carbon atoms which may be substituted (e.g., phenylthio, tolylthio), a carbamoyl group having 1 to 8 carbon atoms which may be substituted (e.g., carbamoyl, N-ethylcarbamoyl), and an acylamino group having 1 to 8 carbon atoms (e.g., acetylamino, methanesulfonylamino). The alkyl or alkenyl group represented by $R_1$ or $R_2$ may contain one or more substituents.

Specific examples of the group represented by $R_1$ or $R_2$ include a methyl, ethyl, propyl, allyl, pentyl, hexyl, methoxyethyl, ethoxyethyl, phenethyl, tolylethyl, sulfophenethyl, 2,2,2-trifluoroethyl, 2,2,3,3-tetrafluoropropyl, carbamoylethyl, hydroxyethyl, 2-(2-hydroxyethoxy)ethyl, carboxymethyl, carboxyethyl, ethoxycarbonylmethyl, sulfoethyl, 2-chloro-3-sulfopropyl, 3-sulfopropyl, 2-hydroxy-3-sulfopropyl, 3-sulfobutyl, 4-sulfobutyl, 2-(2,3-dihydroxypropyloxy)ethyl, and 2-(2-(3-sulfopropyloxy)ethoxy)ethyl group.

$R_3$ represents an alkyl group having 1 to 10 carbon atoms which may be substituted by an alkyl group having 1 to 5 carbon atoms (e.g., methyl, ethyl, propyl, methoxyethyl, benzyl, phenethyl).

$X_1$ represents an ion pair necessary for the neutralization of electric charge.

The suffix $n_1$ represents an integer 0 or 1, with the proviso that it is 0 if the compound is an inter salt.

The sensitizing dye represented by general formula (2) will be further described hereinafter.

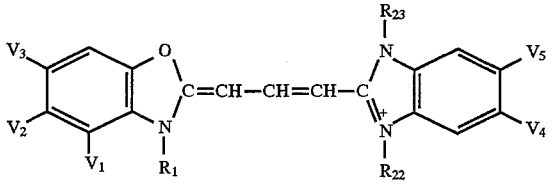

(2)

$(X_{21})_{n21}$

In the general formula (2), $V_1$ represents a hydrogen atom. $V_2$ represents a hydrogen atom, a lower alkyl group which may be branched (preferably an alkyl group having 1 to 6 carbon atoms, such as methyl, ethyl, butyl, isobutyl, hexyl and methoxyethyl), a lower alkoxy group (preferably an alkoxy group having 1 to 5 carbon atoms, such as methoxy, ethoxy, pentyloxy, ethoxymethoxy and hydroxyethoxy), a hydroxy group, a halogen atom, an aryl group having 1 to 9 carbon atoms (e.g., phenyl, tolyl, anisyl, chlorophenyl, carboxyphenyl), an aryloxy group having 1 to 9 carbon atoms (e.g., tolyoxy, anisyloxy, phenoxy, chlorophenoxy), an arylthio group having 1 to 8 carbon atoms (e.g., tolylthio, chlorophenylthio, phenylthio), an alkylthio group having 1 to 4 carbon atoms (e.g., methylthio, ethylthio, hydroxyethylthio) or an acylamino group having 1 to 4 carbon atoms (e.g., acetylamino, propionylamino, methanesulfonylamino) and may be connected to $V_1$ or $V_3$ to form a benzene ring. $V_3$ represents a hydrogen atom, a methyl group or a methoxy group.

$V_4$ represents an electron withdrawing group. Preferred examples of such an electron withdrawing group include a halogen atom, a lower perfluoroalkyl group (more preferably a perfluoroalkyl group having 1 to 5 carbon atoms, such as trifluoromethyl, 2,2,2-trifluoroethyl and 2,2,3,3-tetrafluoropropyl), an acyl group (more preferably an acyl group having 1 to 8 carbon atoms, such as acetyl, propionyl, benzoyl, mesityl and benzenesulfonyl), alkylsulfamoyl group (more preferably an alkylsulfamoyl group having 1 to 5 carbon atoms, such as methylsulfamoyl and ethylsulfamoyl), carboxyl group, alkylcarbonyl group (more preferably an alkylcarbonyl group having 1 to 5 carbon atoms, such as methoxycarbonyl, ethoxycarbonyl and butoxycarbonyl), and cyano group. $V_5$ represents a hydrogen, fluorine, bromine or chlorine atom.

$R_{21}$, $R_{22}$ and $R_{23}$, which may be the same or different, each has the same meaning as $R_1$ or $R_2$, with the proviso that one of $R_{21}$, $R_{22}$ and $R_{23}$ is a group having a sulfo or carboxyl group.

$X_{21}$ represents an ion pair necessary for neutralization of electric charge.

The suffix $n_{21}$ represents an integer 0 or 1, with the proviso that if the compound is an intersalt, it is 0.

| Item | References |
|---|---|
| 1) Nucleation accelerator | Compounds of the general formulae (II), (III), (IV), (V) and (VI) described in Japanese Patent Application No. 4-237366; Compounds of the general formulae (II-m) to (II-p) and (II-1) to (II-22) described in line 13, upper right column, page 9 - line 10, upper left column, page 16 of JP-A-2-103536; compounds as described in JP-A-1-179939 |
| 2) Surface active agent | Line 7, upper right column, page 9 - line 7, lower right column, page 9 of JP-A-2-12236; line 13, lower left column, page 2 - line 18, lower right column page 4 of JP-A-2-18542 |
| 3) Fog Inhibitor | Line 19, lower right column, page 17 - line 4, upper right column, page 18 and line 1–line 5, lower right column, page 18 of JP-A-2-103536; thiosulfinic compounds as described in JP-A-1-237538 |
| 4) Polymer latex | Line 12–line 20, lower left column, page 18 of JP-A-2-103536 |
| 5) Acid group-containing compound | Line 6, lower right column, page 18 - line 1, upper right column, page 19 of JP-A-2-103536 |
| 6) Mat agent, lubricant, plasticizer | Line 15, upper left column, page 19 - line 15, upper right column, page 19 of JP-A-2-103536 |
| 7) Film hardener | Line 5–line 17, upper right column, page 18 of JP-A-2-103536 |
| 8) Dye | Dyes described in line 1–line 18, lower right column, page 17 of JP-A-2-103536; solid dyes described in JP-A-2-294638 and JP-A-5-11382 |
| 9) Binder | Line 1–line 20, lower right column, page 3 of JP-A-2-18542 |

-continued

| Item | References |
|---|---|
| 10) Pepper fog inhibitor | Compounds described in U.S. Pat. No. 4,956,257 and JP-A-1-118832 |
| 11) Redox compound | Compounds of general formula (I) (particularly Exemplary Compounds 1 to 50) as described in JP-A-2-301743; Compounds of the general formulae (R-1), (R-2) and (R-3) Exemplary Compounds 1 to 75 described in JP-A-3-174143, pp. 3–20; compounds described in Japanese Patent Application Nos. 3-69466 and 3-15648 |
| 12) Monomethine compound | Compounds of general formula (II) (particularly Exemplary Compounds II-1 to II-26) as described in JP-A-2-287532 |
| 13) Dihydroxybenzenes | Compounds described in JP-A-3-39948, upper left column, page 11 - lower left column, page 12, and EP452772A |

wherein $V_{31}$ and $V_{32}$ each represents a hydrogen atom or the same substituent groups specified by $V_4$; $V_{32}$ and $V_{34}$ are the same substituent groups specified by $V_4$; $R_{31}$, $R_{32}$, $R_{33}$ and $R_{34}$ may be the same or different and are the same substituent group as those specified by $R_1$ and $R_2$, in which at least one of $R_{31}$, $R_{32}$, $R_{33}$, and $R_{34}$ represents a group having a sulfo or a carboxyl group; $X_{31}$ represents an ion pair which is necessary to neutralize an electron; and $n_{31}$ represents 0 or 1, with the proviso that if the compound represented by general formula (3) is an intersalt, $n_{31}$ is 0.

In order to incorporate the spectral sensitizing dye of the present invention represented by general formula (1), (2) or (3) into silver halide emulsion of the present invention, it may be directly dispersed in the emulsion or may be added to the emulsion in the form of a solution in one or a mixture of solvents such as water, methanol, ethanol, propanol, acetone, methylcellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Further examples of method of incorporating the spectral sensitizing dyes represented by general formula (1), (2) or (3) into the silver halide emulsion include a method described in U.S. Pat. No. 3,469,987 which comprises dissolving a dye in a volatile organic solvent, dispersing the solution in water or a hydrophilic colloid, and then adding the dispersion to an emulsion, a method described in JP-B-46-24185 (the term "JP-B" as used herein means an "examined Japanese patent publication") which comprises dispersing a water-insoluble dye directly into a water-soluble solvent, and then adding the dispersion to an emulsion, a method described in JP-B-44-23389, JP-B-44-27555 and JP-B-57-22091 which comprises dissolving a dye in an acid and then adding the solution to an emulsion or comprises adding a dye to an emulsion in the form of aqueous solution with an acid or base present therein, a method described in U.S. Pat Nos. 3,822,135 and 4,006,025 which comprises adding a dye to an emulsion in the form of an aqueous solution or a colloidal dispersion with a surface active agent present therein, a method described in JP-A-53-102733 and JP-A-58-105141 which comprises dispersing a dye directly into a hydrophilic colloid and then adding the dispersion to an emulsion, and a method described in JP-A-51-74624 which comprises dissolving a dye with a compound which causes red shifting and then adding the solution to an emulsion.

The dissolution of a dye may also be accomplished by an ultrasonic wave.

The time at which the sensitizing dye to be used in the present invention is added to the silver halide emulsion of the present invention may be during any step for emulsion preparation which has been heretofore considered appropriate for the addition of sensitizing dyes. For example, as disclosed in U.S. Pat. Nos. 2,735,766, 3,628,960, 4,183,756, and 4,225,666, JP-A-58-184,142, and JP-A-60-196,749, it may be during the formation of silver halide grains and/or before or during the desalting of silver halide and/or between completion of the desalting of silver halide and the beginning of chemical ripening. As disclosed in JP-A-58-113920, it may be shortly after or during the chemical ripening or any time or step between the chemical ripening and the coating of emulsion. As disclosed in U.S. Pat. No. 4,225,666 and JP-A-58-7629, a compound may be batchwise added singly or in combination with other compounds having different structures to the system in any steps, for example, during the formation of grains and during the chemical ripening, or after the chemical ripening; or before, during and after the chemical ripening. The kind of compounds to be batchwise added and the combination of these compounds may be altered.

Examples of the sensitizing dyes which can be used in the present invention are .described in JP-B-48-38406, JP-B-43-4936, JP-B-48-28293, JP-B-48-25652, JP-B-43-22884, JP-B-54-34609, JP-B-54-34610, JP-B-57-22368, JP-B-57-10418, and JP-A-50-23220. These sensitizing dyes can be synthesized in accordance with the methods described in these patents and in French Patents 1,108,788 and 2,174,418. If the present invention is applied to silver halide emulsions, these sensitizing dyes may be used in combination with blue-sensitive or bluish green-sensitive sensitizing dyes as described in JP-A-62-15439, JP-A-62-287250, JP-A-53-71829, and U.S. Pat. No. 3,667,960 for the purpose of widening the wavelength range to which the photographic material is sensitive or for like purposes. In the case where the present invention is applied to silver halide photographic materials, if it is desired to enhance the sensitivity at a specific spectral range, an agglomerate of sensitizing dye suitable for the spectral range is preferably formed. Among sensitizing dyes represented by the foregoing general formulae (1), (2) and (3), those which can easily form a so-called J-agglomerate are particularly preferred. Further, the combined use of a water-soluble bromide or a water-soluble additive (e.g., bispuridinium salt compound, mercapto-containing heterocyclic sulfon compound, alkaline metal salt) as described in JP-B-49-46932, JP-A-58-28738, and U.S. Pat. No. 3,776,738 advantageously reinforces J-agglomerates. Such a compound may be used in an amount of $10^{-5}$ to 1 mol per mol of silver halide.

Examples of the sensitizing dye which can be used in the present invention are shown below, but the present invention should not be construed as being limited thereto.

Examples of sensitizing dyes represented by general formula (1)

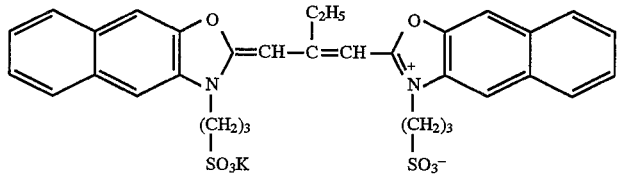

(1-A)

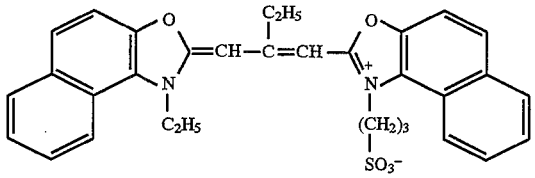

(1-B)

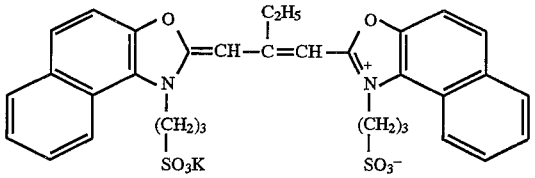

(1-C)

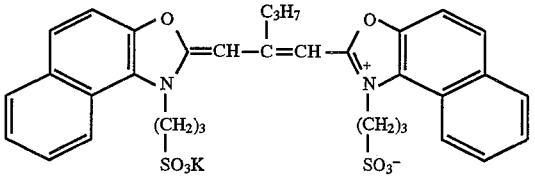

(1-D)

-continued
(1-E)
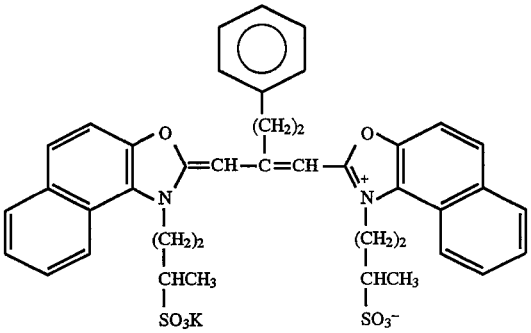
(1-F)
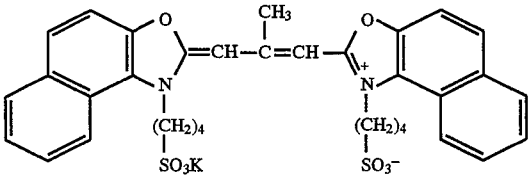
(1-G)
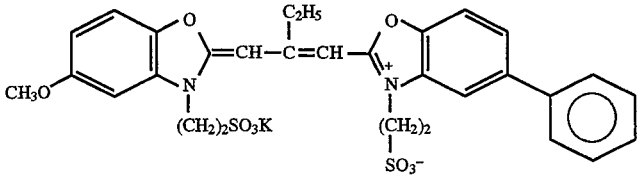
(1-H)
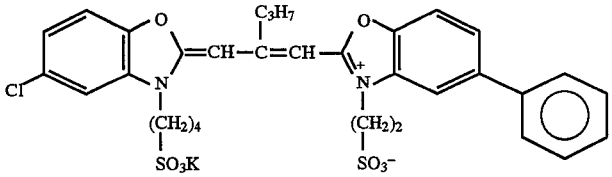
(1-I)
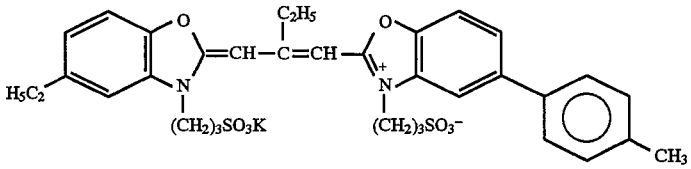
(1-J)
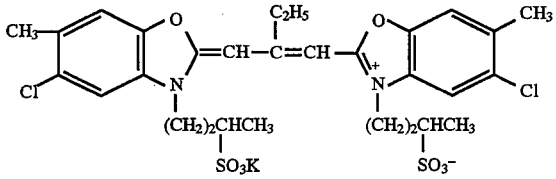
(1-K)
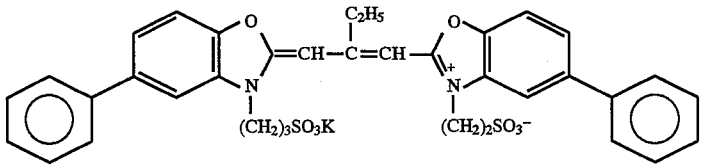
(1-L)
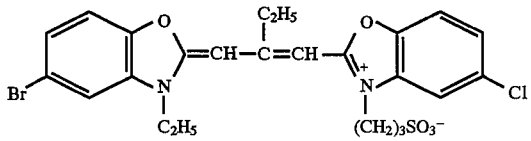

-continued
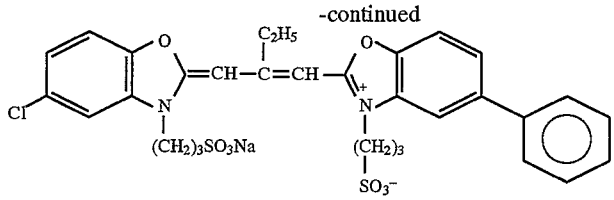
(1-M)
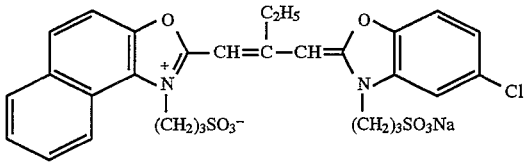
(1-N)
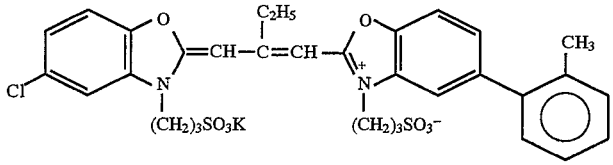
(1-O)
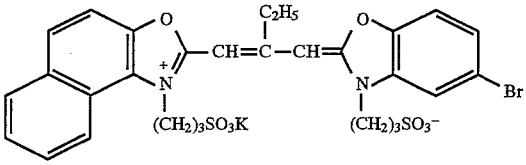
(1-P)
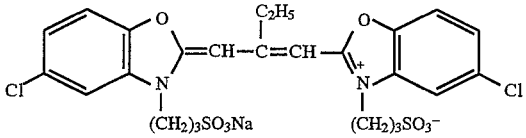
(1-Q)
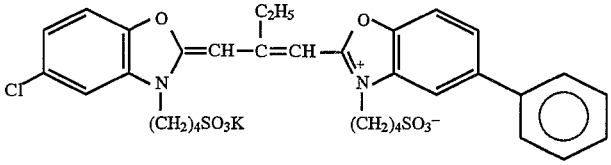
(1-R)
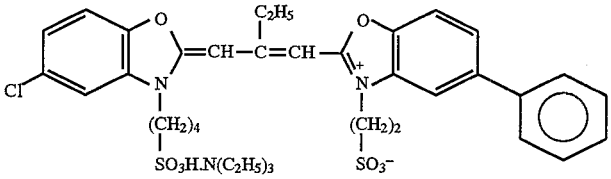
(1-S)
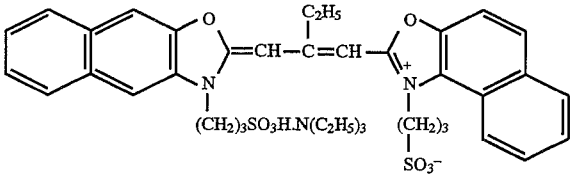
(1-T)
Examples of sensitizing dyes represented by general formula (2)

(2-A)
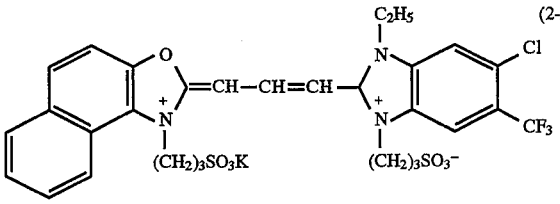
(2-B)
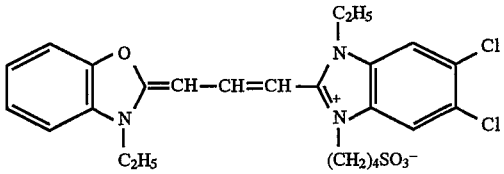
(2-C)
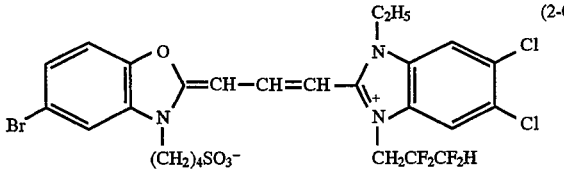
(2-D)
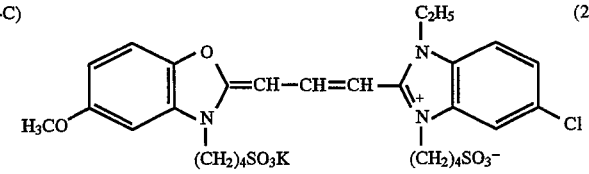
(2-E)
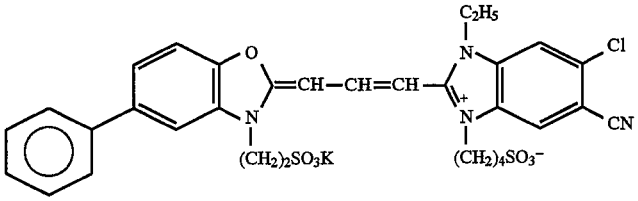
(2-F)
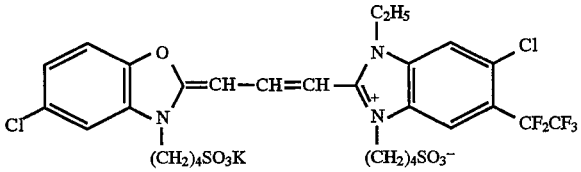
(2-G)
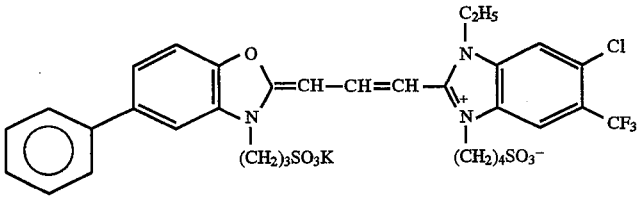
(2-H)
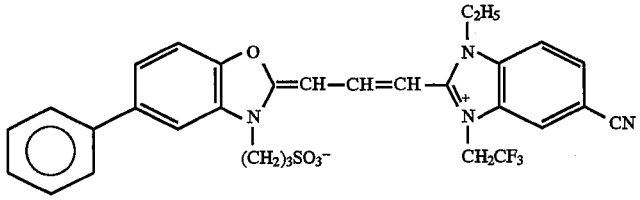
(2-I)
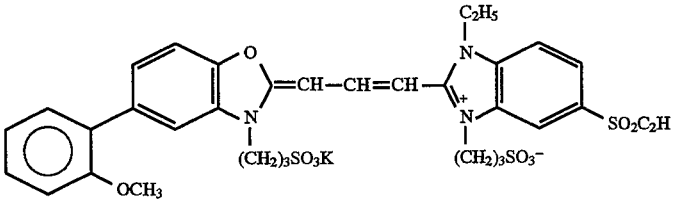
(2-J)
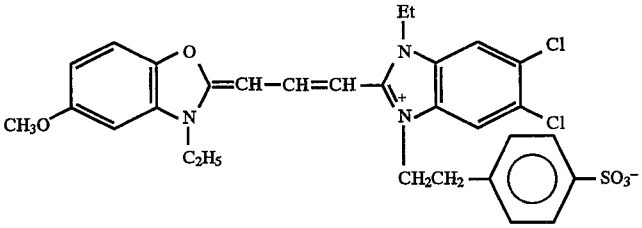

-continued
(2-K)
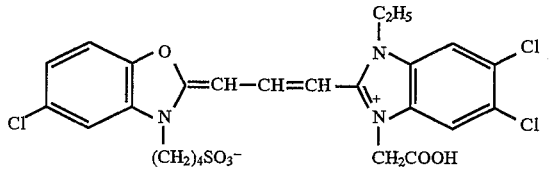
(2-L)
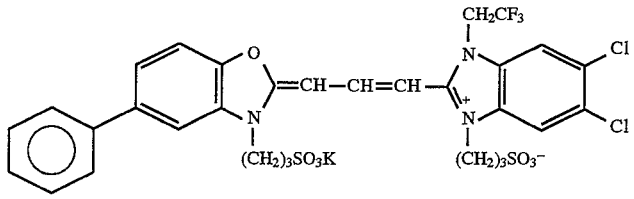
(2-M)
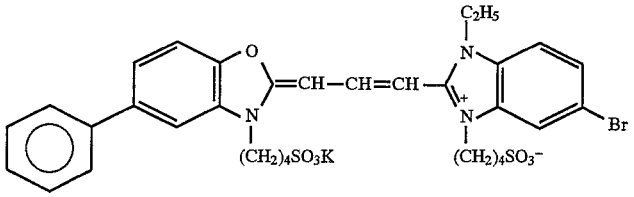
(2-N)
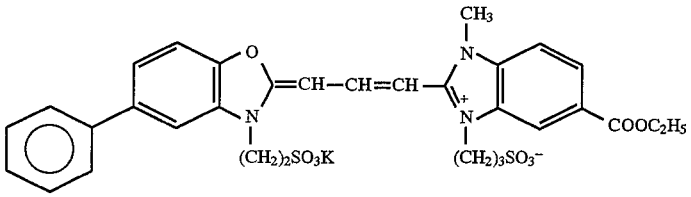
(2-O)
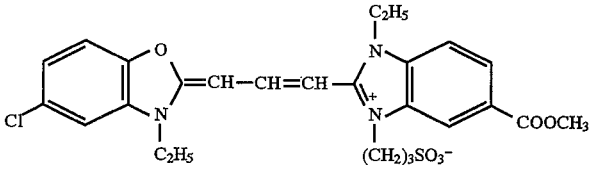
(2-P)
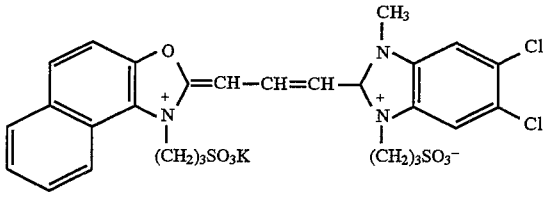
(2-Q)
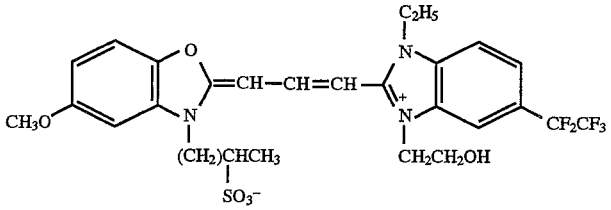
(3-A)
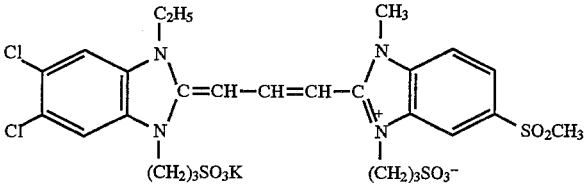

-continued
(3-B)
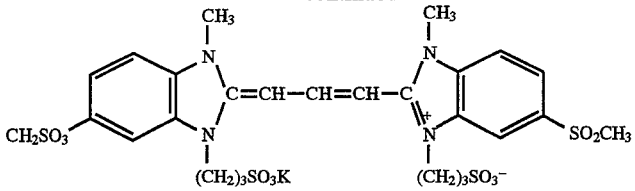
(3-C)
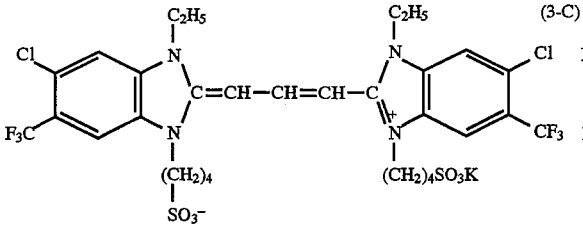
(3-D)
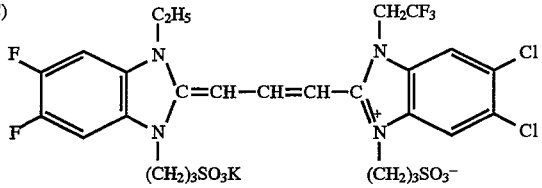
(3-E)
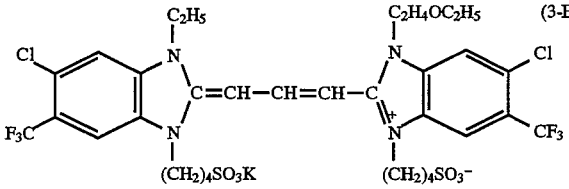
(3-F)
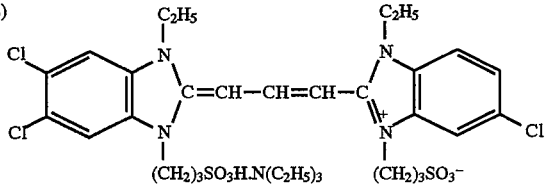
(3-G)
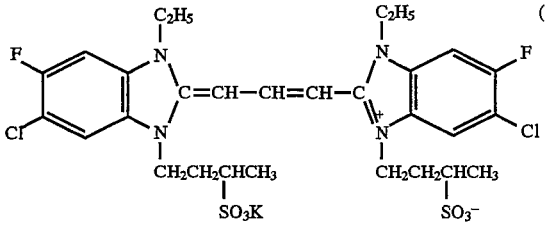
(3-H)
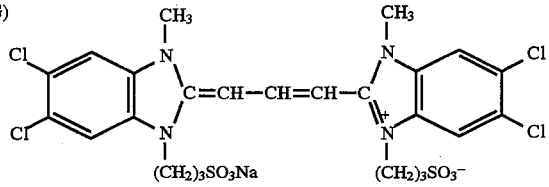
(3-I)
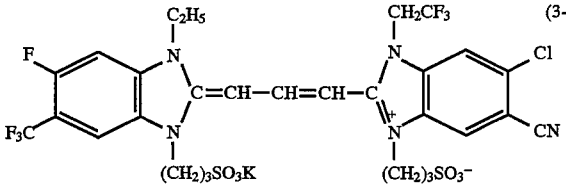
(3-J)
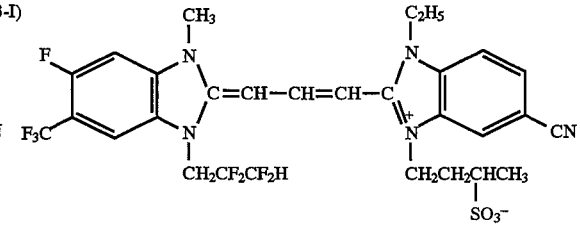
(3-K)
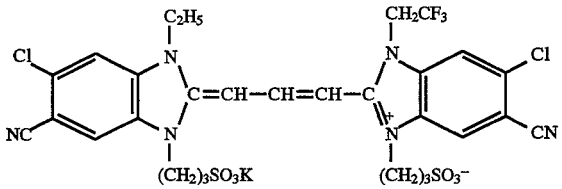
(3-L)
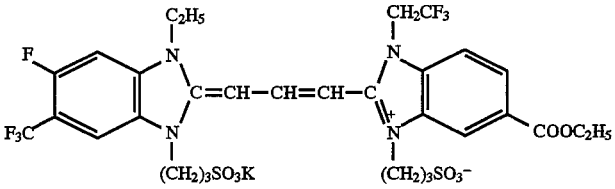
(3-M)
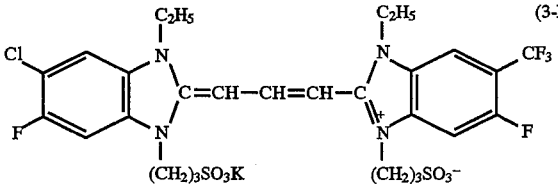
(3-N)
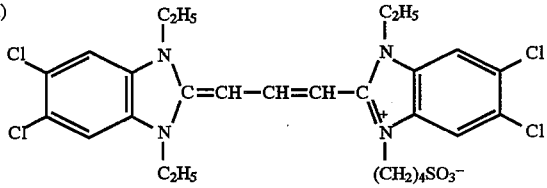

-continued

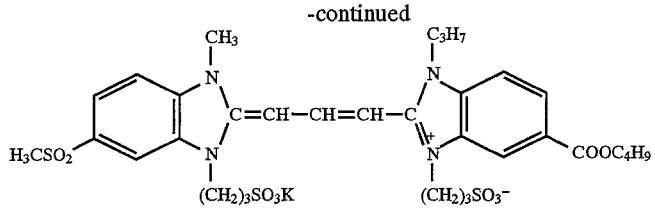

(3-O)

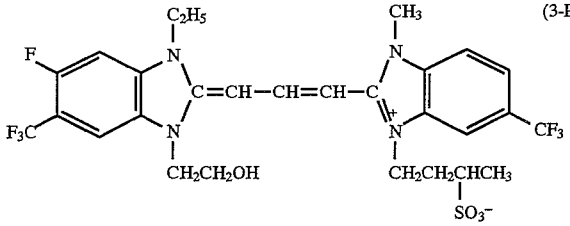

(3-P)

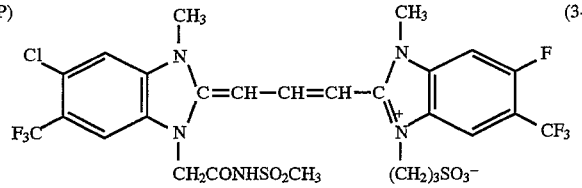

(3-Q)

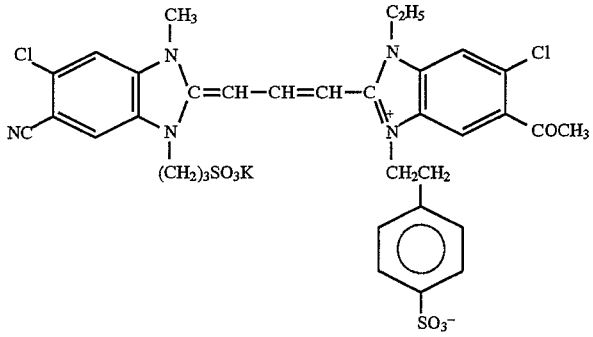

(3-R)

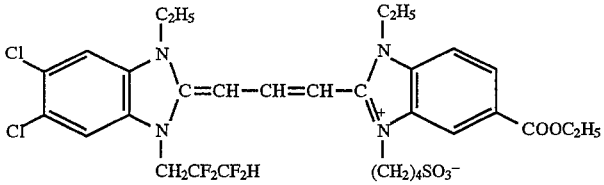

(3-S)

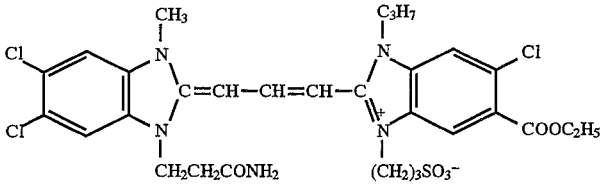

(3-T)

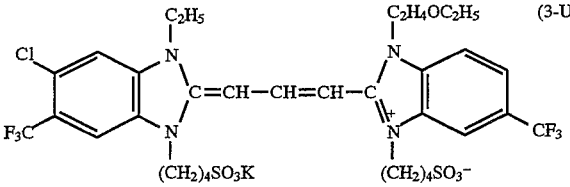

(3-U)

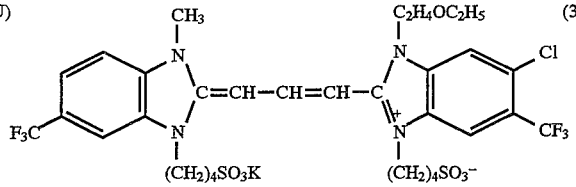

(3-V)

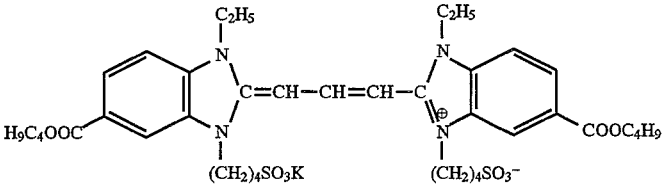

(3-W)

The amount of the spectral sensitizing dye of the present invention represented by general formula (1), (2) or (3) to be added depends on the shape and size of silver halide grains and is normally in the range of $4\times10^{-6}$ to $8\times10^{-3}$ mol per mol of silver halide. For example, if the grain size of silver halide grains is in the range of 0.2 to 1.3 μm, the added amount of the spectral sensitizing dye is preferably in the range of $2\times10^{-7}$ to $3.5\times10^{-6}$ mol, more preferably $6.5\times10^{-7}$ to $2.0\times10^{-6}$ mol, per $m^2$ as unit surface area of silver halide grain.

The hydrazine derivatives to be used in the present invention are those represented by one of general formulae (4) to (6).

The hydrazine derivative represented by general formula (4) will be further described hereinafter.

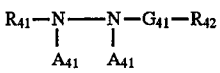

(4)

In general formula (4), $R_{41}$ represents an aliphatic group or aromatic group. $R_{41}$ contains as a partial structure a moiety —O—$(CH_2CH_2O)_n$—, —O—$(CH_2CH(CH_3)O)_n$— or —O—$(CH_2CH(OH)CH_2O)_n$— (in which n is an integer 3 or more) or a group containing a quaternary ammonium cation. $G_{41}$ represents —CO—, —COCO—, —CS—, —C(=$NG_{42}R_{42}$)—, —SO—, —$SO_{42}$— or —P(O)($G_{42}R_{42}$)—. $G_{42}$ represents a single bond, —O—, —S— or —N($R_{42}$)—. $R_{42}$ represents an aliphatic group, an aromatic group or a hydrogen atom. If there is a plurality of $R_{42}$ groups in the molecule, they may be the same or different.

One of $A_{41}$ and $A_{42}$ represents a hydrogen atom, and the other represents a hydrogen atom, an acyl group, an alkylsulfonyl group or an arylsulfonyl group.

The description of general formula (4) will continue in more detail.

In general formula (4), the aliphatic group represented by $R_{41}$ is preferably a $C_{1-30}$, particularly $C_{1-20}$, straight-chain, branched or cyclic alkyl group. The alkyl group has substituents.

In general formula (4), the aromatic group represented by $R_{41}$ is a monocyclic or bicyclic aryl group or unsaturated heterocyclic group. The unsaturated heterocyclic group may be condensed with aryl groups to form a heteroaryl group.

Examples of such a heteroaryl group include a benzene ring, a naphthalene ring, a pyridine ring, a quinoline ring, and an isoquinoline ring. Particularly preferred among these heteroaryl groups are those containing a benzene ring.

A particularly preferred example of the group represented by $R_{41}$ is an aryl group.

The aliphatic group or aromatic group represented by $R_{41}$ is substituted by substituents. Typical examples of such substituents include an alkyl group, an aralkyl group, an alkenyl group, an alkinyl group, an alkoxy group, an aryl group, a substituted amino group, a ureide group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, and a phosphoric amide group. Particularly preferred among these substituents are a straight-chain, branched or cyclic alkyl group (preferably having 1 to 20 carbon atoms), an aralkyl group (preferably having 7 to 30 carbon atoms), an alkoxy group (preferably having 1 to 30 carbon atoms), a substituted amino group (preferably amino group substituted by a $C_{1-30}$ alkyl group), an acylamino group (preferably having 2 to 40 carbon atoms), a sulfonamide group (preferably having 1 to 40 carbon atoms), a ureide group (preferably having 1 to 40 carbon atoms), and a phosphoric amide group (preferably having 1 to 40 carbon atoms).

The aliphatic group or aromatic group represented by $R_{41}$ or substituents thereof contain —O—$(CH_2CH_2O)_n$—, —O—$(CH_2CH(CH_3)O)_n$—, —O—$(CH_2CH(OH)CH_2O)_n$— or a quaternary ammonium cation. The suffix n is an integer 3 or more, preferably 3 to 15.

$R_{41}$ is preferably represented by the following general formula (H1), (H2), (H3) or (H4):

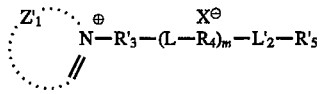

(H1)

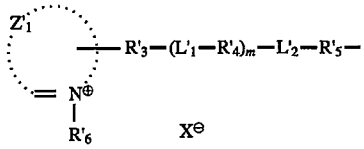

(H2)

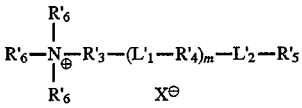

(H3)

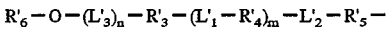

(H4)

In these general formulae, $L'_1$ and $L'_2$, which may be the same or different, each represents —$CONR'_7$—, —$NR'_7CONR'_8$—, —$SO_2NR'_7$— or —$NR'_7SO_3NR'_8$—. $R'_7$ and $R'_8$ each represents a hydrogen atom, a $C_{1-6}$ alkyl group or a $C_{6-10}$ aryl group, preferably a hydrogen atom. The suffix m is 0 or 1.

$R'_3$, $R'_4$ and $R'_5$ each is a divalent aliphatic group or aromatic group, preferably alkylene group, arylene group or divalent group formed by the combination of these groups with —O—, —CO—, —S—, —SO—, —$SO_2$— or —$NR'_9$— (in which $R'_9$ has the same meaning as $R'_7$ in general formulae (H2), (H3) and (H4)).

More preferably, $R'_3$ is a $C_{1-10}$ alkylene group or divalent group formed by the combination of the alkylene group with —S—, —SO— or —$SO_2$—. $R'_4$ and $R'_5$ each is a $C_{6-20}$ arylene group. In particular, $R'_5$ is preferably a phenylene group.

$R'_3$, $R'_4$ and $R'_5$ may be substituted by substituents. Preferred examples of such substituents include those described with reference to $R'_1$.

In general formulae (H1) and (H2), $Z'_1$ represents an atomic group necessary for the formation of a nitrogen-containing aromatic group. Preferred examples of the nitrogen-containing heterocyclic aromatic ring formed by $Z'_1$ and the nitrogen atom include a pyridine ring, a pyrimidine ring, a pyridazine ring, a pyrazine ring, a imidazole ring, a pyrazole ring, a pyrrole ring, an oxazole ring, a thiazole ring, a benzo-condensed ring thereof, a pteridine ring, and a naphthyridine ring.

In general formulae (H1), (H2) and (H3), $X^-$ represents a paired anion or a moiety of a paired anion if it forms an inter salt.

In general formulae (H2), (H3) and (H4), $R'_6$ represents an aliphatic group or aromatic group. Preferably, $R'_6$ is a $C_{1-20}$ alkyl group or $C_{6-20}$ aryl group.

In general formula (H3), the three $R'_6$ groups may be the same or different or may be connected to each other to form a ring.

$Z'_1$ and $R'_6$ may be substituted by substituents. Preferred examples of such substituents include those described with reference to $R'_1$.

In general formula (H4), $L'_3$ represents —$CH_2CH_2O$—, —$CH_2CH(CH_3)O$— or —$CH_2CH(OH)CH_2O$—. The suffix n is an integer of 3 to 30.

In general formula (4), $G'_1$ is preferably —CO— or —$SO_2$—, most preferably —CO—.

$A'_1$ and $A'_2$ each is preferably a hydrogen atom.

In general formula (4), the alkyl group represented by $R_{42}$ is preferably a $C_{1-4}$ alkyl group, and the aryl group is preferably monocyclic or bicyclic (containing, for example, benzene ring).

If $G_{41}$ is —CO—, preferred examples of the group represented by $R_{42}$ include a hydrogen atom, an alkyl group (e.g., methyl, methoxymethyl, phenoxymethyl, trifluoromethyl, 3-hydroxypropyl, 3-methanesulfonamidepropyl, phenylsulfonylmethyl), an aralkyl group (e.g., o-hydroxybenzyl), and an aryl group (e.g., phenyl, 3,5-dichlorophenyl, o-methanesuylfonamidephenyl, 4-methanesulfonylphenyl, 2-hydroxymethylphenyl). Particularly preferred is a hydrogen atom.

$R_{42}$ may be substituted by substituents. Examples of such substituents include those described with reference to $R_{41}$.

Further, $R_{42}$ may be a group which causes the $G_{41}$—$R_{42}$ moiety to be separated from the rest of the molecule and a cyclization reaction that produces a cyclic structure containing the $G_{41}$—$R_{42}$ moiety. Examples of such a group are described in JP-A-63-29751.

In general formula (4), $R_{41}$ or $R_{42}$ may contain a ballast group or polymer commonly used for immobile photographic additives such as couplers. The ballast group is a relatively photographically inert group having 8 or more carbon atoms and can be selected from the group consisting of an alkyl group, an alkoxy group, a phenyl group, an alkylphenyl group, a phenoxy group, and an alkylphenoxy group. Examples of the polymer include those described in JP-A-1-100530.

In general formula (4), $R_{41}$ or $R_{42}$ may contain a group which intensifies the adsorption to the surface of silver halide grains. Examples of such an adsorption group include a thiourea group, a heterocyclic thioamide group, a mercaptoheterocyclic group and a triazole group as described in U.S. Pat. Nos. 4,385,108, and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

The compound of the present invention represented by general formula (4) can be synthesized in accordance with the methods described in JP-A-61-213847, JP-A-62-260153, JP-A-49-129536, JP-A-56-153336, JP-A-56-153342, U.S. Pat. Nos. 4,684,604, 3,379,529, 3,620,746, 4,377,634, 4,332,878, 4,988,604, and 4,994,365, and Japanese Patent Application No. 63-803.

Examples of the compound represented by general formula (4) which can be used in the present invention are shown below, but the present invention should not be construed as being limited thereto.

(Compound 4-1)

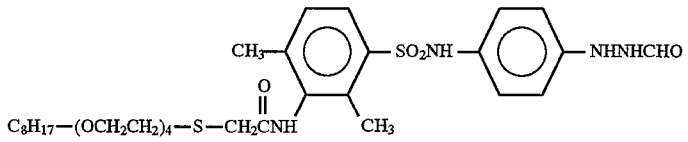

(Compound 4-2)

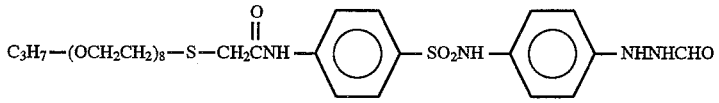

(Compound 4-3)

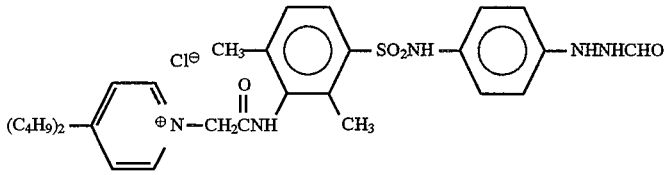

(Compound 4-4)

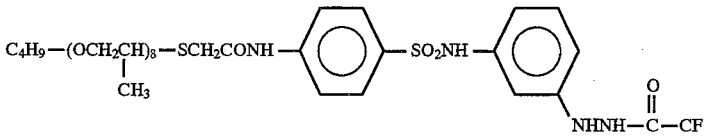

(Compound 4-5)

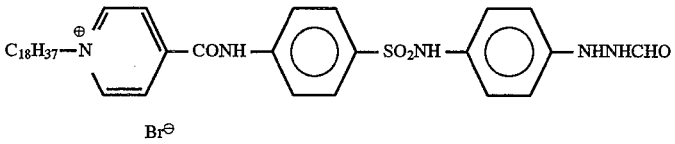

(Compound 4-6)

-continued

K-38

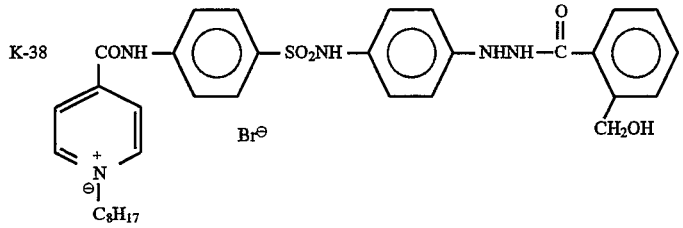

(Compound 4-7)

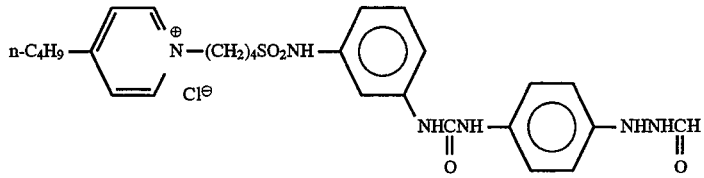

(Compound 4-8)

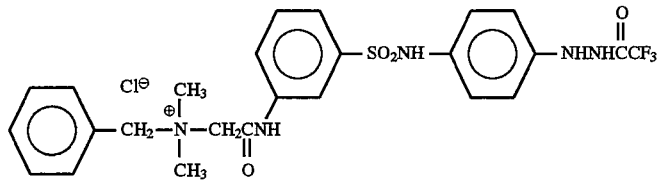

(Compound 4-9)

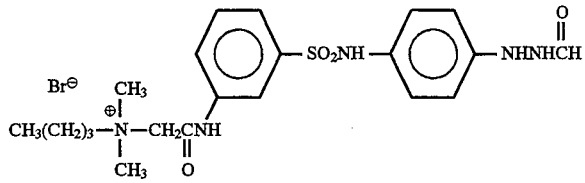

(Compound 4-10)

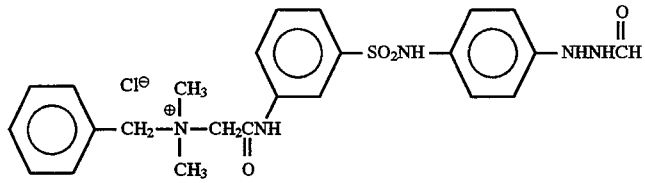

The compound represented by general formula (5) is further described hereinafter.

$$R_{51}—NHNH—G_{51}—R_{52} \quad (5)$$

$R_{51}$ represents an aliphatic group, aromatic group or heterocyclic group which may be substituted.

$G_{51}$ represents —CO—, —$SO_2$—, —SO—, —COCO—, thiocarbonyl, iminomethylene or —P(O)($R_{53}$)— group. $R_{52}$ represents a substituted alkyl group in which the carbon atom bonded to $G_{51}$ is substituted by at least one electron drawing group. $R_{53}$ represents a hydrogen atom, aliphatic group, aromatic group, alkoxy group, aryloxy group or amino group.

The compound represented by the general formula (5) is further described hereinafter.

In general formula (5), the aliphatic group represented by $R_{51}$ is a straight-chain, branched or cyclic alkyl, alkenyl or alkinyl group having 1 to 30 carbon atoms.

The aromatic group represented by $R_{51}$ is a monocyclic or bicyclic aryl group such as a phenyl group and a naphthyl group.

The heterocyclic group represented by $R_{51}$ is a 3- to 10-membered saturated or unsaturated heterocyclic group containing at least one N, O or S atom. The heterocyclic group may be monocyclic or may form a condensed ring with other aromatic groups or heterocyclic groups. The heterocyclic group is preferably a 5- or 6-membered aromatic heterocyclic group. For example, those containing a pyridine group, an imidazolyl group, a quinolinyl group, a benzimidazolyl group, a pyrimidyl group, a pyrazolyl group, an isoquinolinyl group, a thiazoline group, a benzthiazolyl group, etc., are preferred.

Examples of the group represented by $R_{51}$ include an aromatic group, a nitrogen-containing heterocyclic group, and a group represented by general formula (b):

$$X_b\text{-}(C(E_b^1)=C(R_b^2))_r(C(R_b^3)=C(R_b^4))_s \quad (b)$$

wherein $X_b$ represents an aromatic group or a nitrogen-containing heterocyclic group; $R_b^1$ to $R_b^4$ each represents a hydrogen atom, a halogen atom or an alkyl group; $X_b$ and $R_b^1$ to $R_b^4$ may contain substituents if possible; and r and s each represents an integer 0 or 1.

$R_{51}$ is more preferably an aromatic group, particularly an aryl group.

$R_{51}$ may be substituted by substituents. Examples of such substituents include an alkyl group, an aralkyl group, an alkenyl group, an alkinyl group, an alkoxy group, an aryl group, a substituted amino group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an alkyloxycarbonyl group, an aryloxycarbonyl group, an acyl group, an alkoxycarbonyl group, an acyloxy group, a carbonamide group, a sulfonamide group, a nitro group, an alkylthio group, an arylthio group, and a group represented by the following general formula (c):

$$R_{c1}-L-Y_c-\underset{\underset{R_{c2}}{\|}}{N}- \qquad (c)$$

wherein Yc represents —CO—, —$SO_2$—, —P(O)($R_{c3}$)— (in which $R_{c3}$ represents an alkoxy or aryloxy group) or —OP(O)($R_{c3}$)—; L represents a single bond, —O—, —S— or —$NR_{c4}$— (in which $R_{c4}$ represents a hydrogen atom, an aliphatic group or an aromatic group); and $R_{c1}$ and $R_{c2}$ each represents a hydrogen atom, an aliphatic group, an aromatic group or a heterocyclic group and may be the same or different or may be connected to each other to form a ring.

$R_{51}$ may contain one or more groups represented by general formula (c).

In general formula (c), the aliphatic group represented by $R_{c1}$ is a straight-chain, branched or cyclic alkyl, alkenyl or alkinyl group having 1 to 30 carbon atoms.

The aromatic group represented by $R_{c1}$ is a monocyclic or bicyclic aryl group such as phenyl or naphthyl.

The heterocyclic group represented by $R_{c1}$ is a 3- to 10-membered heterocyclic group containing at least one of N, O and S atoms. The heterocyclic group may be monocyclic or may form a condensed ring with other aromatic groups or heterocyclic groups. The heterocyclic group is preferably a 5- or 6-membered aromatic heterocyclic group. For example, those containing a pyridine group, an imidazolyl group, a quinolinyl group, a benzimidazolyl group, a pyrimidyl group, a pyrazolyl group, an isoquinolinyl group, a thiazolyl group, a benzthiazolyl group, etc. are preferred.

$R_{c1}$ may be substituted by substituents. Examples of such substituents include the following groups. These groups may be further substituted by substituents.

Examples of the substituents include an alkyl group, an aralkyl group, an alkenyl group, an alkinyl group, an alkoxy group, an aryl group, a substituted amino group, an acylamino group, a sulfonylamino group, a ureide group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an alkyloxycarbonyl group, an aryloxycarbonyl group, an acyl group, an alkoxycarbonyl group, an acyloxy group, a carbonamide group, a sulfonamide group, a nitro group, an alkylthio group, and an arylthio group.

These groups may be connected to each other to form a ring if possible.

In general formula (c), the aliphatic group represented by $R_{c2}$ is a straight-chain, branched or cyclic alkyl, alkenyl or alkinyl group.

The aromatic group represented by $R_{c2}$ is a monocyclic or bicyclic aryl group such as a phenyl group.

$R_{c2}$ may be substituted by substituents. Examples of such substituents include those described with reference to $R_{c1}$ in the general formula (c).

$R_{c1}$ and $R_{c2}$ may be connected to each other to form a ring if possible.

$R_{c2}$ is preferably a hydrogen atom.

In general formula (c), $Y_c$ is preferably —CO— or —$SO_2$—, and L is preferably a single bond or —$NR_{c4}$—.

In general formula (c), the aliphatic group represented by $R_{c4}$ is a straight-chain, branched or cyclic alkyl, alkenyl or alkinyl group.

The aromatic group represented by $R_{c4}$ is a monocyclic or bicyclic aryl group such as phenyl group.

$R_{c4}$ may be substituted by substituents. Examples of such substituents include those described with reference to $R_{c1}$ in general formula (c).

$R_{c4}$ is preferably a hydrogen atom.

In general formula (5), $G_1$ is most preferably —CO—.

In general formula (5), $R_2$ represents a substituted alkyl group in which the carbon atom bonded to $G_1$ is substituted by at least one, preferably two, particularly three, electron withdrawing groups.

In $R_2$, the electron withdrawing group which is substituted to the carbon atom bonded to $G_1$ is preferably one having a $\delta p$ value of 0.2 or more and a $\delta m$ value of 0.3 or more. Examples of such an electron withdrawing group include a halogen atom, a cyano group, a nitro group, a nitroso group, a polyhaloalkyl group, a polyhaloaryl group, an alkylcarbonyl group, an arylcarbonyl group, a formyl group, an alkyloxycarbonyl group, an aryloxycarbonyl group, an alkylcarbonyloxy group, a carbamoyl group, an alkylsulfinyl group, an arylsulfinyl group, an alkylsulfonyl group, an arylsulfonyl group, an alkylsulfonyloxy group, an arylsulfonyloxy group, a sulfamoyl group, a phosphino group, a phosphine oxide group, a phosphonic ester group, a phosphonic amide group, an arylazo group, an amidino group, an ammonio group, a sulfonio group, and an electron-lacking heterocyclic group.

In general formula (5), $R_{52}$ is particularly preferably a trifluoromethyl group.

In general formula (5), $R_{51}$ or $R_{52}$ may contain a ballast group or polymer commonly used for immobile photographic additives such as couplers. The ballast group is a relatively photographically inert group having 8 or more carbon atoms and can be selected from the group consisting of an alkyl group, an alkoxy group, a phenyl group, an alkylphenyl group, a phenoxy group, and an alkylphenoxy group. Examples of the polymer include those described in JP-A-1-100530.

In general formula (5), $R_{51}$ or $R_{52}$ may contain a group which intensifies the adsorption to the surface of silver halide grains. Examples of such an adsorption group include a thiourea group, a heterocyclic thioamide group, a mercaptoheterocyclic group and a triazole group as described in U.S. Pat. Nos. 4,385,108, and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

Examples of the compounds represented by general formula (5) are shown below, but the present invention should not be construed as being limited thereto.

(5-1)
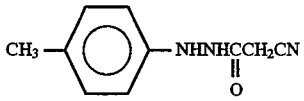
(5-2)
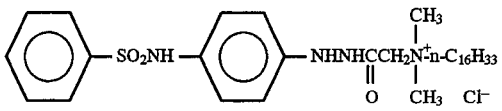
(5-3)
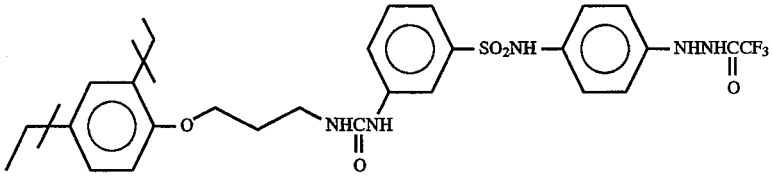
(5-4)
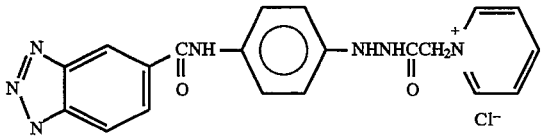
(5-5)
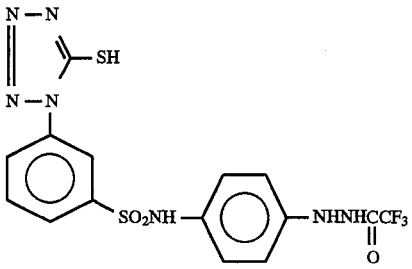
(5-6)
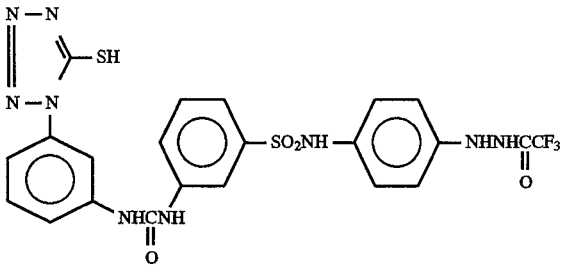
(5-7)
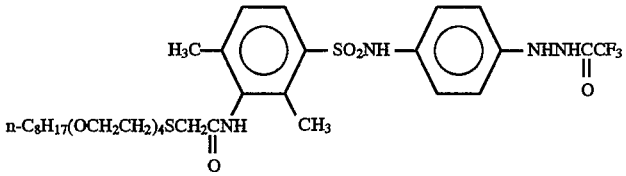
(5-8)
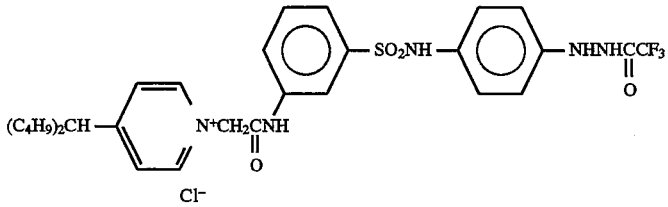
(5-9)
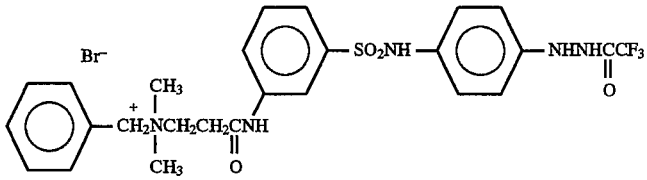

The hydrazine derivatives according to the present invention may be prepared by well known synthesizing methods which comprises, for example, reacting a corresponding hydrazine with a corresponding carboxylic acid, acid halide or acid anhydride such as sulfonyl chloride, acylchloride, acid anhydride or active ester, in the presence of a condensation agent, such as di-cyclohexylcarbo-diimide.

In the case where $A_{51}$ or $A_{52}$ represents $R_3SO_2$—, a reaction of corresponding haloacetyl hydrazide derivative with $R_{53}SO_2H$ in the presence of a base may be utilized.

An synthesis example of the hydrazine derivative may be shown as follows.

Synthesis Example

Synthesis of the exemplified compound 5-3

To a mixture of 63.2 g of starting compound A, which is shown below, and 200 ml of tetrahydrofrane, 15.3 ml of triethyl amine was added, and the mixture was cooled to 5° C. After adding 16.9 ml of trifluoroacetate anhydride, the mixture was stirred over night at a room temperature. The mixture was poured into 1N aqueous solution of hydrochloride and a reaction product was extracted. An organic layer was washed with saturated aqueous sodium chloride solution, dried with magnesium sulfate anhydride, and distilled ethyl acetate off. A product was isolated and purified through silicagel chromatography to obtain 52.1 g of the object product. A chemical constitution of the compound was confirmed by nmr spectrum and ir spectrum.

Starting Compound A

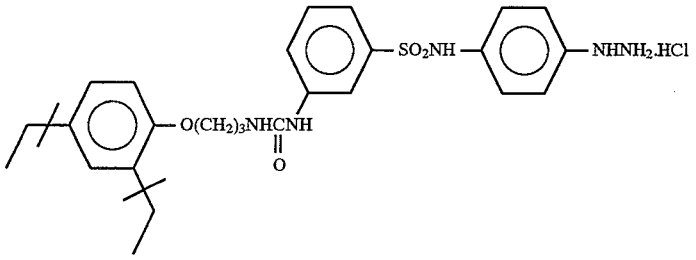

The compounds represented by general formula (6) are further described hereinafter.

$$R_a-\underset{A_{61}}{N}-\underset{A_{62}}{N}-G_{61}-R_b \qquad (6)$$

In general formula (6), the aliphatic group represented by $R_a$ is a straight-chain, branched or cyclic alkyl, alkenyl or alkinyl group having 1 to 30 carbon atoms.

The aromatic group represented by $R_a$ is a monocyclic or bicyclic aryl group such as phenyl and naphthyl group.

The heterocyclic group represented by $R_a$ is a 3- to 10-membered negative saturated or unsaturated heterocyclic group containing at least one N, O or S atom. The heterocyclic group may be monocyclic or may form a condensed ring with other aromatic groups or heterocyclic groups. The heterocyclic group is preferably a 5- or 6-membered aromatic heterocyclic group. For example, a pyridine group, an imidazolyl group, a quinolinyl group, a benzimidazolyl group, a pyrimidyl group, a pyrazolyl group, an isoquinolinyl group, a thiazolyl group, a benzthiazolyl group, etc., are preferred.

$R_a$ may be substituted by substituents. Examples of such substituents include the following groups. These groups may be further substituted by substituents.

Examples of the substituents include an alkyl group, an aralkyl group, an alkoxy group, an aryl group, a substituted amino group, an acylamino group, a sulfonylamino group, a ureide group, a urethane group, an aryloxy group, a sulfamoyl group, a carbamoyl group, an aryl group, an alkylthio group, an arylthio group, a sulfonyl group, a sulfinyl group, a hydroxyl group, a halogen atom, a cyano group, a sulfo group, and a carboxyl group.

These groups may be connected to each other to form a ring if possible.

$R_a$ is preferably an aromatic group, more preferably an aryl group.

Preferred among the groups represented by $R_b$, if $G_{61}$ is a carbonyl group, are a hydrogen atom, an alkyl group (e.g., methyl, trifluoromethyl, 3-hydroxypropyl, 3-methanesulfonamidepropyl), an aralkyl group (e.g., o-hydroxybenzyl), and an aryl group (e.g., phenyl, 3,5-dichlorophenyl, o-methanesulfonamidephenyl, 4-methanesulfonylphenyl). Particularly preferred among these groups is hydrogen atom.

If $G_{61}$ is a sulfonyl group, $R_b$ is preferably an alkyl group (e.g., methyl), an aralkyl group (e.g., o-hydroxyphenylmethyl), an aryl group (e.g., phenyl) or a substituted amino group (e.g., dimethylamino).

If $G_1$ is a sulfoxy group, $R_b$ is preferably a cyanobenzyl or methylthiobenzyl group. If $G_{61}$ is a phosphoryl group, $R_b$ is preferably a methoxy, ethoxy, butoxy, phenoxy or phenyl group, particularly a phenoxy group.

If $G_{61}$ is an N-substituted or unsubstituted iminomethylene group, $R_b$ is preferably a methyl, ethyl or substituent or unsubstituted phenyl group.

Examples of substituents for $R_b$ include substituent groups described with reference to $R_a$, an acyl group, an acyloxy group, an alkyloxycarbonyl group, an aryloxycarbonyl group, an alkenyl group, an alkinyl group, and a nitro group.

These substituents may be further substituted by these substituents. If possible, these substituents may be connected to each other to form a ring.

The group for acclerating adsorption to silver halide which can substitute on $R_a$ or $R_b$ can be represented by $X_{61}$—$(L_{61})_q$—.

$X_{61}$ is a group for accelerating adsorption to silver halide. $L_{61}$ is a divalent connecting group. The suffix q is 0 or 1.

Preferred examples of the adsorption accelerating group represented by $X_{61}$ include a thioamide group, a mercapto group, a disulfide bond-containing group, and a 5- or 6-membered nitrogen-containing heterocyclic group.

The thioamide adsorption accelerating group represented by $X_{61}$ may be a divalent group represented by —CS-amino- which is a part of the cyclic structure or may be a noncyclic thioamide group. Useful thioamide adsorption groups may be selected from those disclosed in U.S. Pat. Nos. 4,030,925, 4,031,127, 4,080,207, 4,245,037, 4,255,511, 4,266,013, and 4,276,364, and *Research Disclosure Nos.* 15162, vol. 151, December 1976, and 17626, vol. 176, December 1978.

Specific examples of the noncyclic thioamide group include a thioureide group, a thiourethane group, and a dithiocarbaminic ester. Specific examples of the cyclic thioamide group include 4-thiazoline-2-thione, 4-imidazoline-2-thione, 2-thiohydantoin, rhodanine, thiobarbituric acid, tetrazolin-5-thione, 1,2,4-triazolin-3-thione, 1,3,4-thiadiazolin-2-thione, 1,3,4-oxadiazolin-2-thione, benzimidazolin-2-thione, benzoxazolin-2-thione, and benzothiazolin-2-thione. These cyclic thioamide groups may be further substituted.

Examples of the mercapto group represented by $X_{61}$ include an aliphatic mercapto group, an aromatic mercapto group, and a heterocyclic mercapto group (if the atom adjacent to the carbon atom to which —SH group is connected is a nitrogen atom, this mercapto group has the same meaning as cyclic thioamide group in tautomerism therewith; specific examples of this group include those described above).

Examples of the 5- or 6-membered nitrogen-containing heterocyclic group represented by $X_{61}$ include 5- or 6-membered nitrogen-containing heterocyclic groups comprising nitrogen, oxygen, sulfur and carbon atoms. Preferred among these 5- or 6-membered nitrogen-containing heterocyclic groups are benzotriazole, triazole, tetrazole, indazole, benzimidazole, imidazole, benzothiazole, thiazole, benzooxazole, oxazole, thiadiazole, oxadiazole, and triazine. These 5- or 6-membered nitrogen-containing heterocyclic groups may be substituted by proper substituents.

Examples of such substituents include those described with reference to $R_a$.

Preferred among the groups represented by $X_1$ are state-of-the-art thioamide groups (i.e., mercapto-substituted nitrogen-containing heterocyclic groups, e.g., 2-mercaptothiadiazole, 3-mercapto-1,2,4-triazole, 5-mercaptotetrazole, 2-mercapto-1,3,4-oxadiazole, 2-mercaptobenzoxazole), and nitrogen-containing heterocyclic groups (e.g., benzotriazole, benzimidazole, indazole).

The compounds represented by the general formula (6) may be substituted by two or more ($X_{61}$—(L61)$_q$) groups. These ($X_{61}$—($L_{61}$)$_q$) groups may be the same or different.

The divalent connecting group represented by $L_{61}$ is an atom or atomic group containing at least one C, N, S or O. Specific examples of such an atomic group include an alkylene group, an alkenylene group, an alkinylene group, an arylene group, —O—, —S—, —NH—, —CO—, and —$SO_2$— (these groups may contain substituents), singly or in combination.

These groups may be further substituted by proper substituents.

Examples of such substituents include those described with reference to $R_a$.

$A_{61}$ and $A_{62}$ each represents a hydrogen atom, an alkylsulfonyl or arylsulfonyl group having 20 or less carbon atoms (preferably phenylsulfonyl group or phenylsulfonyl group substituted such that the sum of Hammett's substituent constants is −0.5 or more), an acyl group having 20 or less carbon atoms (preferably benzoyl group or benzoyl group substituted such that the sum of Hammett's substituent constants is −0.5 or more) or a straight-chain, branched or cyclic substituted or unsubstituted aliphatic acyl group (examples of such substituents include halogen atom, ether group, sulfonamide group, carbonamide group, hydroxyl group, carboxyl group, and sulfonic group). Examples of the sulfinic group represented by $A_{61}$ or $A_{62}$ include those described in U.S. Pat. No. 4,478,928.

$A_{61}$ and $A_{62}$ each is preferably a hydrogen atom.

In general formula (6), $G_{61}$ is most preferably a carbonyl group.

Preferred among the compounds represented by general formula (6) are those represented by general formula (6-a):

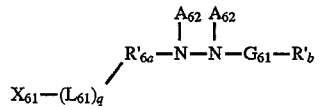

(6-a)

In general formula (6-a), $R'_a$ is a group obtained by excluding one hydrogen atom from $R_a$. At least one of $R'_a$, $R_b$ and $L_{61}$ contains a group that can dissociate into cations having a pKa value of 6 or more or amino group.

Preferred among the groups which can dissociate into cations having a pKa value of 6 or more are any substituents which dissociate little into cations having a pKa value of 8 to 13 in a neutral or weakly acidic medium but thoroughly in an alkaline aqueous solution (preferably having pH 10.5 to 12.3) such as a developer.

Examples of such substituents include a hydroxyl group, a group represented by —$SO_2$NH—, a hydroxyimino group, an active methylene group, and an active methine group (e.g., —$CH_2$COO—, —$CH_2$CO—, —CH(CN)—COO—).

The amino group may be primary, secondary or tertiary. The amino group is preferably one whose conjugate acid has a pKa value of 6.0 or more.

$A_{61}$, $A_{62}$, $G_{61}$, $R'_b$, $L_{61}$, $X_{61}$ and q are as defined in general formula (6).

Particularly preferred among the groups represented by general formula (6) are those represented by general formula (6-b):

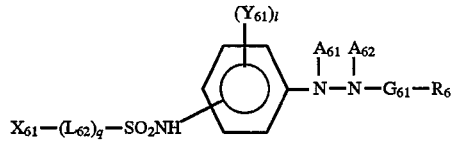

(6-b)

In general formula (6-b), $L_{62}$ has the same meaning as $L_{61}$ in general formulae (6) and (6-a). $Y_{61}$ has the same meaning as $R_{61}$ in general formula (6). The suffix q represents an integer 0 or 1. The suffix l represents an integer 0, 1 or 2. When l is 2, the two $Y_{61}$ groups may be the same or different.

$A_{61}$, $A_{62}$, $G_{61}$, $R_b$, $L_{61}$, and $X_{61}$ are as defined in general formulae (6) and (6-a).

More preferably, $X_{61}$—($L_{62}$)$_q$—$SO_2$NH is substituted in the p-position of the hydrazino group.

The compounds represented by the general formula (6) can be synthesized in accordance with methods described in JP-A-56-67843, JP-A-60-179734, JP-A-61-236548, JP-A-61-270744 and JP-A-62-270948.

Specific examples of the compounds represented by general formula (6) are shown below, but the present invention should not be construed as being limited thereto.

(Compound 6-1)
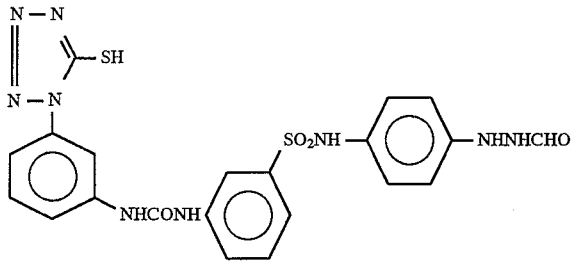
(Compound 6-2)
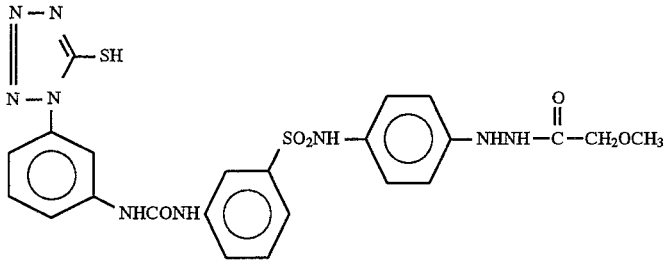
(Compound 6-3)
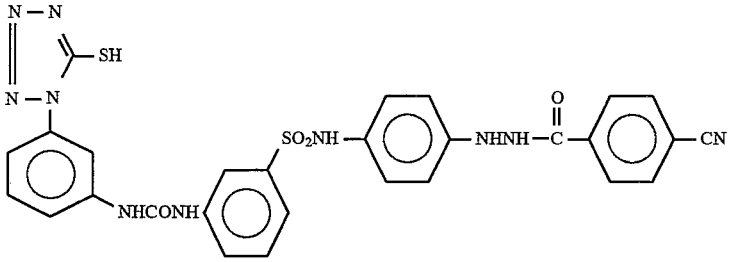
(Compound 6-4)
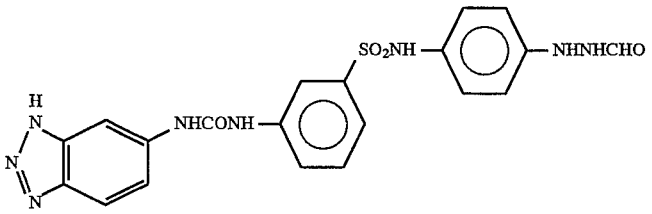
(Compound 6-5)
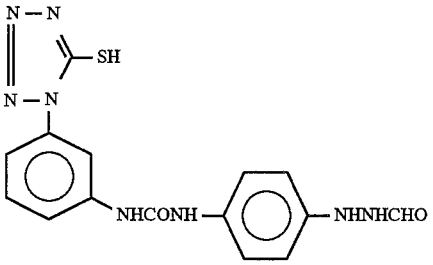
(Compound 6-6)

-continued

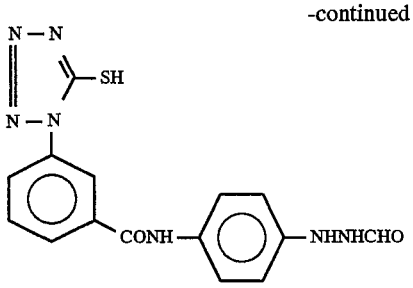

(Compound 6-7)

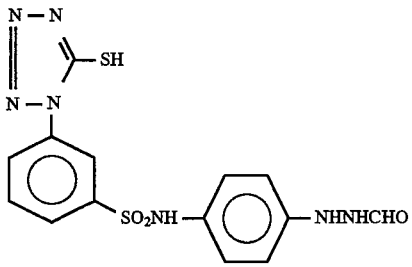

The amount of the hydrazine compound of the present invention to be incorporated is preferably in the range of $1\times10^{-6}$ mol to $5\times10^{-2}$ mol, particularly $1\times10^{-5}$ mol to $2\times10^{-2}$ mol, per mol of silver halide.

The hydrazine compound of the present invention can be used in the form of solution in a proper water-miscible solvent such as alcohols (e.g., methanol, ethanol, propanol, fluorinated alcohol), ketone (e.g., acetone, methyl ethyl ketone), a dimethylformamide, a dimethylsulfoxide and a methyl cellosolve.

A well known emulsion dispersion method can be used to dissolve the hydrazine compound in an oil such as dibutyl phthalate, tricresyl phosphate, glyceryl triacetate and diethyl phthalate or auxiliary solvent such as ethyl acetate and cyclohexanone to mechanically prepare an emulsion dispersion. Alternatively, a method known as a solid dispersion method can be used to disperse a powdered hydrazine compound in water by means of a ball mill or colloid mill or by an ultrasonic apparatus.

The mercaptoazoles represented by general formula (7) to be used in the present invention will be further described hereinafter.

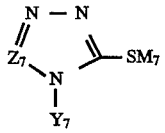

(7)

In general formula (7), $Z_7$ represents N or C—$X_7$ (in which $X_7$ represents an alkyl or aryl group); $Y_7$ represents an alkyl having a hydrophilic group or aryl having a hydrophilic group; and $M_7$ represents a hydrogen atom, a metal atom or ammonium.

The alkyl, aryl and ammonium groups represented by $X_7$, $Y_7$ and $M_7$ may further contain substituents.

Preferred among the groups represented by $X_7$ are $C_{1-30}$ substituted or unsubstituted alkyl groups, $C_{6-30}$ substituted or unsubstituted phenyl groups, and $C_{10-30}$ substituted or unsubstituted naphthyl groups.

Preferred among the groups represented by $Y_7$ are $C_{1-30}$ alkyl groups substituted with hydrophilic group and $C_{6-30}$ aryl group substituted with hydrophilic group. Particularly preferred among these groups are $C_{6-30}$ phenyl groups, and $C_{10-30}$ substituted or unsubstituted naphthyl groups, each substituted with hydrophilic group.

An example of preferable hydrophilic group includes —$SO_3M_8$, —$SO_2NHR_{71}$, —$NHSO_2R_{71}$, —$CO_2NHR_{71}$, —$PO_3M_8$, —$PO(OR_{71})_2$, —$PO(NHR_{71})_2$, —$COOM_8$, or —OH, and more preferably —$SO_3M_8$, —$COOM_8$ or —OH, (wherein $R_{71}$ represents a hydrogen atom or an alkyl group having 1 to 5 carbon atoms; and $M_8$ represents a hydrogen atom, an alkali metal, a quarternary ammonium or a quarternary phosphonium).

Specific examples of the compound represented by general formula (7) which can be used in the present invention shown below, but the present invention should not be construed as being limited thereto.

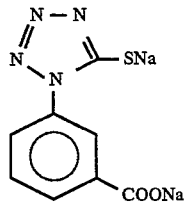

(7-1)

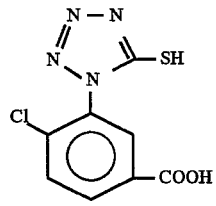

(7-2)

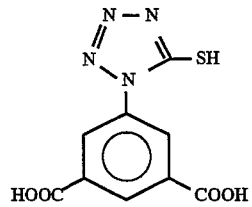

(7-3)

-continued
(7-4)
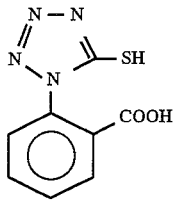
(7-5)
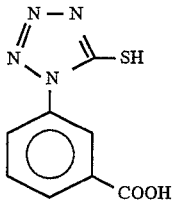
(7-6)
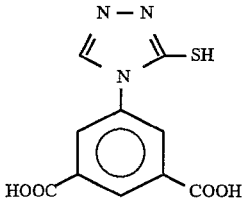
(7-7)
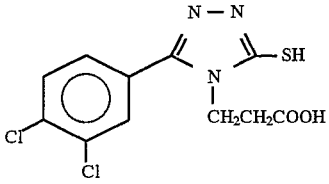
(7-8)
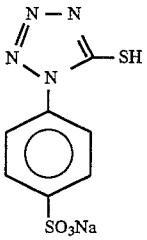
(7-9)
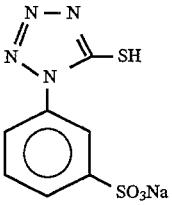
(7-10)
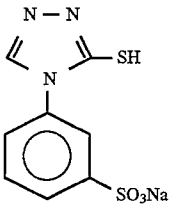
-continued
(7-11)
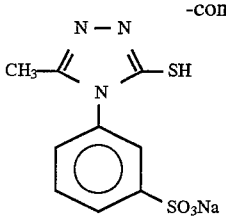
(7-12)
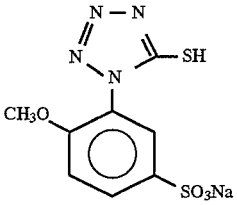
(7-13)
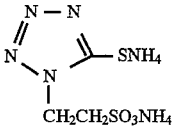
(7-14)
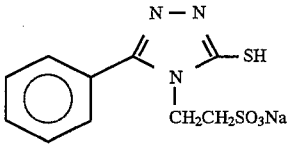
(7-15)
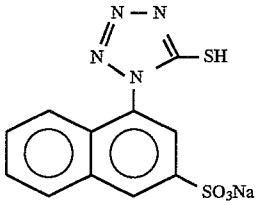
(7-16)
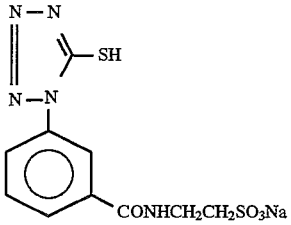
(7-17)
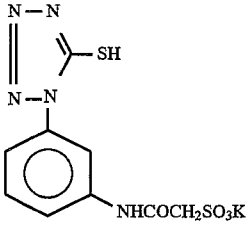
(7-18)
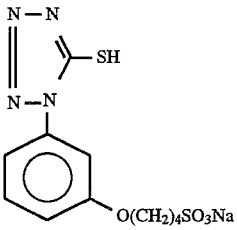

-continued (7-19)

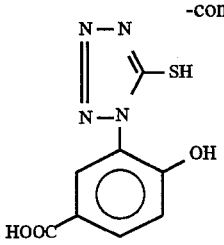

(7-20)

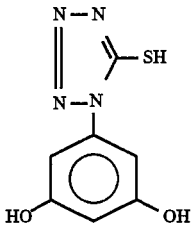

(7-21)

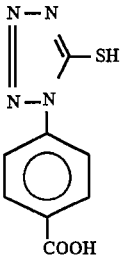

(7-22)

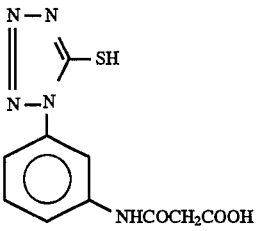

(7-23)

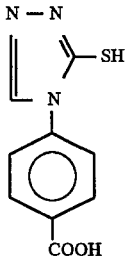

(7-24)

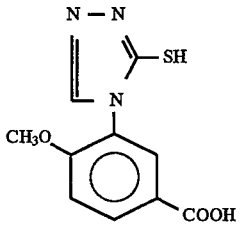

(7-25)

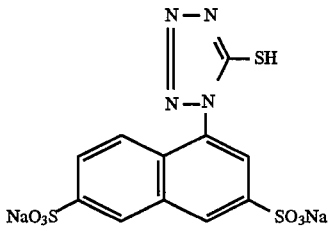

-continued (7-26)

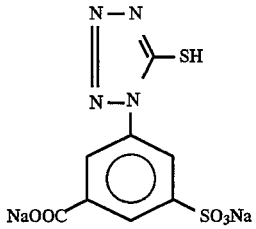

The compounds represented by general formula (6) can be easily synthesized from an isothiocyanate as a starting material as is well known.

Patents and references in which useful synthesis methods are described are given below.

U.S. Pat. Nos. 2,585,388, and 2,541,924, JP-B-42-21842, JP-A-53-50169, British Patent 1,275,701, D. A. Berges et al, *Journal of Heterocyclic Chemistry*, vol. 15, page 981 (1978); *The Chemistry of Heterocyclic Chemistry, Imidazole and Derivatives* part I., pp. 336–339; *Chemical Abstract* 58, No. 7921 (1963), page 394) E. Hoggarth, *Journal of Chemical Society,* 1949 edition, pp. 1160–1167; and S. R. Sandler, and W. Karo, *Organic Functional Group Preparations*, Academic Press, 1968, pp. 312–315.

These compounds are added to the photographic emulsion or a hydrophilic colloid solution from which constituent layers other than emulsion layers (e.g., top coat, filter layer, interlayer, preferably the layer adjacent to the emulsion layer) are prepared in the form of an aqueous solution, a hydrochloric aqueous solution or a methanol solution. The time at which these compounds are added to the system is not specifically limited. If added to the photographic emulsion, it is advantageously added between after the second ripening and shortly before the coating. The amount of these compounds to be added is normally in the range of $10^{-6}$ to $10^{-2}$ mol, preferably $5\times10^{-5}$ to $2\times10^{-3}$ mol, per mol of silver.

The triazine compound represented by general formula (8) which can be used in the present invention are further described hereinafter.

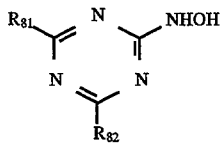

(8)

wherein $R_{81}$ and $R_{82}$, which may be the same or different, each represents a hydroxyl group, a hydroxylamino group, an amino group, an alkylamino group (preferably $C_{1-5}$ alkyl mono- or di-substituted amino group), an aralkylamino group (preferably having 7 to 11 carbon atoms), an arylamino group (preferably amino group substituted by $C_{6-10}$ aryl group), an alkoxy group (preferably having 1 to 5 carbon atoms), a phenoxy group, an alkyl group (preferably having 1 to 5 carbon atoms), an aryl group (preferably having 6 to 10 carbon atoms), an alkylthio group (preferably having 1 to 5 carbon atoms), and a phenylthio group.

The alkyl moiety in these groups may have substituents such as a hydroxyl group, an alkoxy group (preferably having 1 to 4 carbon atoms, particularly 1 to 2 carbon atoms), an amino group, and an alkylamino group (preferably $C_{1-4}$, particularly $C_{1-2}$ alkyl mono- or di-substituted amino group). In the groups represented by $R_{81}$ or $R_{82}$, the aryl or phenyl moiety may have substituents such as a hydroxyl group, an amino group, an alkylamino group (preferably $C_{1-4}$, particularly $C_{1-2}$ alkyl mono- or di-substituted amino group), an alkyl group (preferably having 1 to 4 carbon atoms, particularly 1 to 2 carbon atoms), and an alkoxy group (preferably having 1 to 4 carbon atoms, particularly 1 to 2 carbon atoms).

The use of the compounds represented by general formula (8) is exemplified in JP-A-63-75737.

Examples of the compound represented by the general formula (8) which can be preferably used in the present invention are shown below.

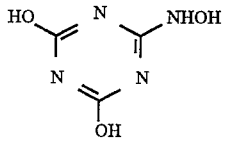
8-1

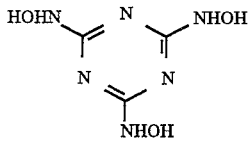
8-2

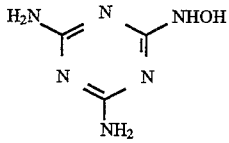
8-3

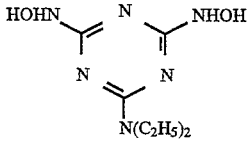
8-4

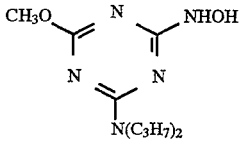
8-5

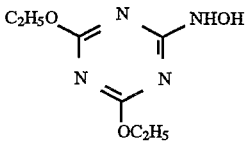
8-6

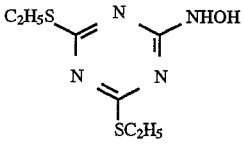
8-7

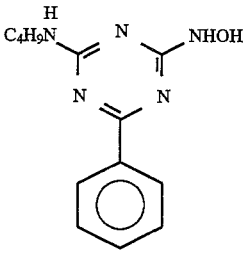
8-8

-continued

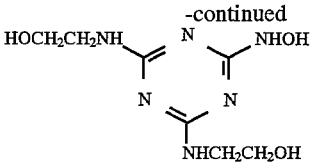
8-9

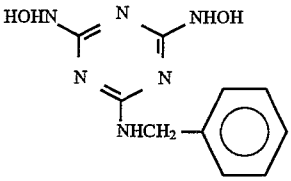
8-10

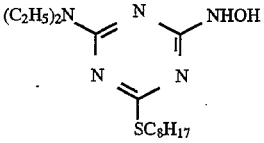
8-11

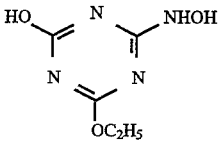
8-12

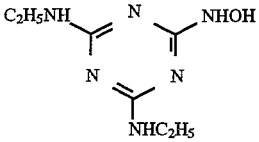
8-13

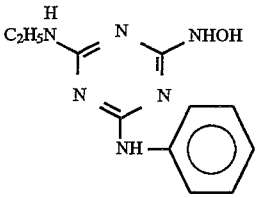
8-14

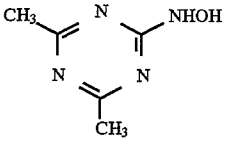
8-15

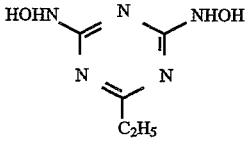
8-16

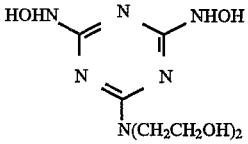
8-17

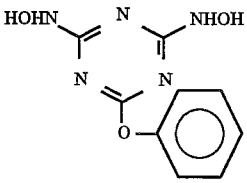
8-18

-continued 8-19

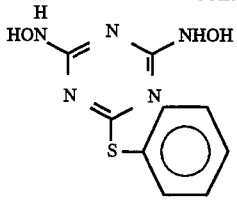

8-20

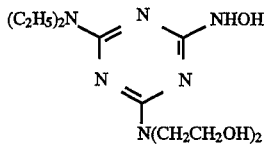

8-21

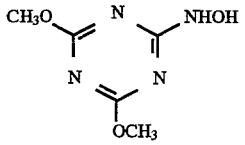

These compounds can be synthesized in accordance with methods as described in *Journal of the Organic Chemistry*, vol. 27, page 4054, 1962, *Journal of the American Chemical Society*, vol. 73, page 2981, 1951, and JP-B-49-10692.

These compounds are added to the photographic emulsion or a hydrophilic colloid solution from which constituent layers other than the emulsion layer (e.g., top coat, filter layer, interlayer, preferably layer adjacent to the emulsion layer) are prepared, preferably the photographic emulsion layer, in the form of an aqueous solution, a hydrochloric aqueous solution or a methanol solution. The time at which these compounds are added to the system is not specifically limited. If added to the photographic emulsion, it is advantageously added between after the second ripening and shortly before the coating. The amount of these compounds to be added is normally in the range of 0.01 g to 10 g, particularly 0.1 g to 1 g, per mol of silver.

The dihydroxybenzenes represented by general formula (9) of the present invention are further described hereinafter.

(9)

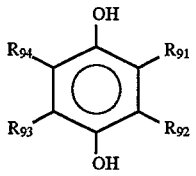

wherein $R_{91}$, $R_{92}$, $R_{93}$ and $R_{94}$ each represents a hydrogen atom, a hydroxyl group, an alkoxy group, an aryloxy group, an alkylthio group, an arylthio group, a halogen atom, a primary, secondary or tertiary amino group, a carbonamide group, a sulfonamide group, an alkyl group, an aryl group, a 5- or 6-membered heterocyclic group containing at least one N, O or S atom, a formyl group, a keto group, a sulfonic group, a carboxylic group, an alkylsulfonyl group or an arylsufonyl group which have 1 to 30 carbon atoms.

The compound represented by general formula (9) are further described hereinafter.

In general formula (9), $R_{91}$, $R_{92}$, $R_{93}$ and $R_{94}$ each represents a hydrogen atom, a hydroxyl group, a substituted or unsubstituted alkoxy group, a substituted or unsubstituted aryloxy group, a substituted or unsubstituted alkylthio group, a substituted or unsubstituted arylthio group, a halogen atom, a primary, secondary or tertiary amino group, a substituted or unsubstituted carbonamide group, a substituted or unsubstituted sulfonamide group, a substituted or unsubstituted alkyl group, a substituted or unsubstituted aryl group, a substituted or unsubstituted 5- or 6-membered heterocyclic group containing at least one N, O or S atom, a formyl group, a keto group, a sulfonic group, a carboxylic group, a substituted or unsubstituted alkylsulfonyl group or a substituted or unsubstituted arylsufonyl group.

Many specific examples of these dihydroxybenzene derivatives represented by general formula (8) are described in, e.g., *The Merck Index*, 10th edition. These examples are also described in U.S. Pat. Nos. 2,728,659, 3,700,453, and 3,227,552, JP-A-49-106329, JP-A-50-156438, JP-A-56-109344, JP-A-57-22237, JP-A-59-202465, JP-A-58-17431, JP-A-57-17949, JP-B-50-21249, JP-B-56-40818, JP-B-59-37497, British Patents 752146, and 1086208, West German Patent 2,149,789, and *Chemical Abstract*, vol. 5, 6367h. Particularly preferred among these preferred dihydroxybenzenes are unsubstituted hydroquinones wherein the sum of Hammett's u value of substituents other than the two hydroxyl groups is in the range of −1.2 to +1.2, particularly −1.0 to +0.5.

Specific examples of these dihydroxybenzenes are shown below, but the present invention should not be construed as being limited thereto.

9-1

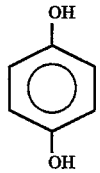

9-2

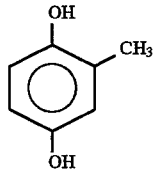

9-3

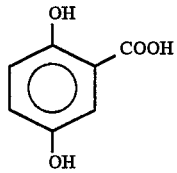

9-4

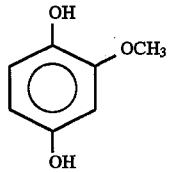

9-5

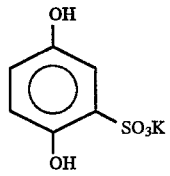

9-6

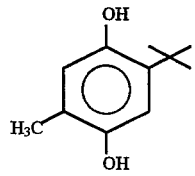

-continued 9-7

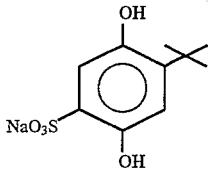

9-8

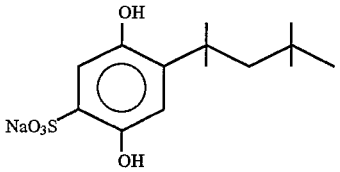

9-9

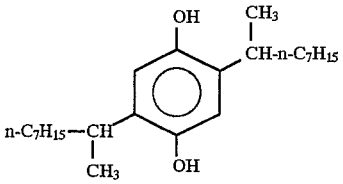

9-10

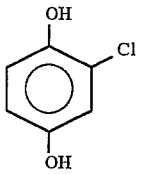

9-11

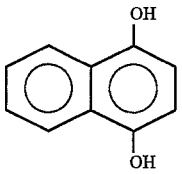

9-12

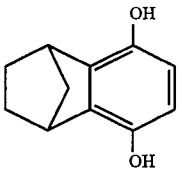

9-13

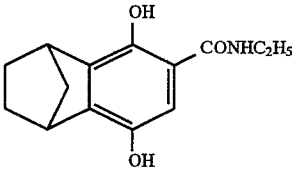

9-14

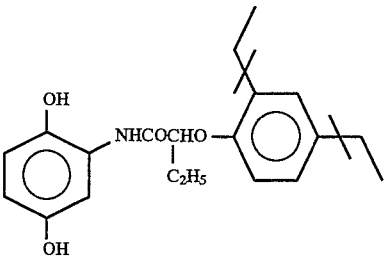

-continued 9-15

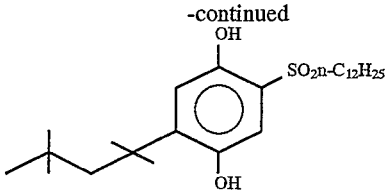

9-16

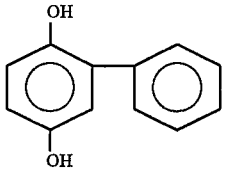

9-17

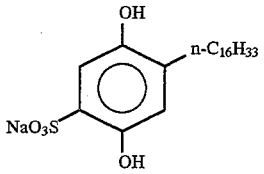

9-18

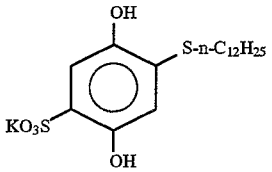

9-19

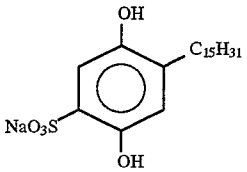

9-20

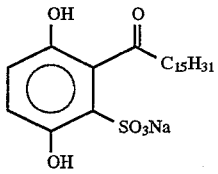

The amount of the compound represented by general formula (9) to be incorporated is preferably in the range of $1\times10^{-6}$ to $5\times10^{-1}$ mol, particularly $1\times10^{-5}$ to $8\times10^{-2}$ mol, per mol of silver halide.

In order to incorporate the compound represented by general formula (9) in the photographic material, the compound may be added to a silver halide emulsion solution or hydrophilic colloid solution in the form of aqueous solution, if it is water-soluble, or solution in an organic solvent miscible with water such as alcohol (e.g., methanol, ethanol), ester (e.g., ethyl acetate) and ketone (e.g., acetone), if it is water-insoluble.

If it is to be incorporated into the silver halide emulsion solution, the incorporation may be effected at any time between the beginning of chemical ripening and before coating, preferably after the completion of chemical ripening. In particular, it is preferably incorporated into a coating solution prepared for coating.

The thiosulfonic compounds represented by general formula (10), (11) or (12) which can be used in the present invention are further described hereinafter.

$$Z_{10}—SO_2—S—M_{10} \quad (10)$$

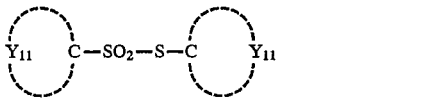

(11)

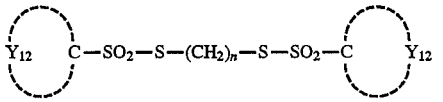

(12)

wherein $Z_{10}$ represents a $C_{1-18}$ alkyl group, $C_{6-18}$ aryl group or heterocyclic group; $Y_{11}$ and $Y_{12}$ each represents a $C_{6-18}$ aromatic group or atoms necessary for the formation of a heterocyclic group; $M_{10}$ represents a metal atom or organic cation; and n represents an integer 2 to 10.

In general formulae (10), (11) and (12), the alkyl group, aryl group, heterocyclic group and aromatic ring represented or formed by $Z_{10}$, $Y_{11}$ and $Y_{12}$ may be substituted by substituents. Examples of such substituents include a $C_{1-10}$ lower alkyl group such as methyl and ethyl groups, an aryl group such as phenyl group, a $C_{1-8}$ alkoxy group, a halogen atoms such as a chlorine atom, a nitro group, an amino group, and a carboxyl group. Examples of the heterocyclic group represented or formed by $Z_{10}$, $Y_{11}$ or $Y_{12}$ include thiazole, benzthiazole, imidazole, benzimidazole, and oxazole rings. Examples of the metal atom represented by $M_{10}$ include alkaline metal atoms such as sodium and potassium ions. The organic cation represented by $M_{10}$ is preferably an ammonium ion, a guanidine group or the like. The group represented by $Z_{10}$ is preferably a $C_{1-12}$ alkyl group.

Specific examples of the compounds represented by general formula (10), (11) and (12) are shown below.

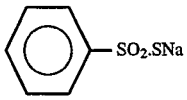

(T-1)

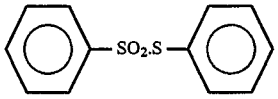

(T-2)

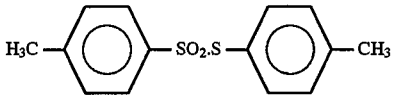

(T-3)

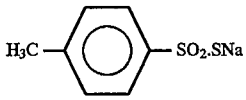

(T-4)

$H_3C.SO_2.SNa$ (T-5)

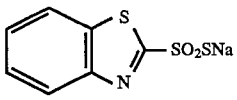

(T-6)

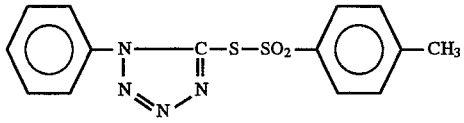

(T-7)

$nC_8H_{17}.SO_2.SNa$ (T-8)

$nC_{12}H_{25}.SO_2.SNa$ (T-9)

-continued $nC_{16}H_{33}.SO_2.SNa$ (T-10)

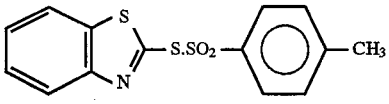

(T-11)

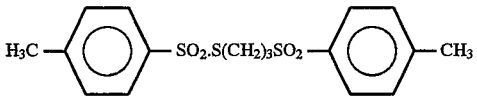

(T-12)

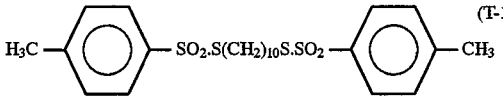

(T-13)

1-Cystine-disulfoxide (T-14)

$C_2H_5.SO_2.SNa$ (T-15)

$C_4H_9.SO_2.SNa$ (T-16)

The compounds represented by general formula (10), (11) or (12) can be normally synthesized by well known methods. For example, a method which comprises the reaction of the sulfonyl chloride in question with sodium sulfide or the reaction of the sodium sulfinate in question with sulfur may be used. On the other hand, these compounds are commercially available. The amount of the compounds of the present invention represented by general formula (10), (11) or (12) to be incorporated is preferably in the range of $1\times10^{-5}$ to $1\times10^{-3}$ mol, particularly $5\times10^{-5}$ to $1\times10^{-3}$ mol, per mol of silver halide. The site at which such a compound is added is preferably a photographic emulsion. The time at which such a compound is added is during the formation of grains, during the chemical ripening of the emulsion or shortly before the coating of the emulsion, particularly shortly before the coating of the emulsion. The photographic material prepared according to the present invention may comprise a water-soluble dye as a filter dye or for the purpose of inhibiting irradiation or for other various purposes. Examples of such a dye include an oxonol dye, a hemioxonol dye, a styryl dye, a melocyanine dye, a cyanine dye, and an azo dye. Particularly useful among these dyes are an oxonol dye, a hemioxonol dye, and a melocyanine dye.

The silver halide emulsion to be incorporated into the silver halide photographic material of the present invention comprises silver bromochloride or silver bromochloroiodide having a silver chloride content of 50 mol % or more and a silver iodide content of 3 mol % or less, preferably 0.5 mol % or less. The crystal form of silver halide grains may be cube, tetradecahedron, octahedron, amorphous or tablet, preferably cube. The average grain diameter of silver halide grains is preferably in the range of 0.1 μm to 0.7 μm, more preferably 0.2 μm to 0.5 μm. The silver halide grains preferably. have a grain diameter distribution as narrow as 15% or less, more preferably 10% or less as calculated in terms of fluctuation coefficient represented by {(standard deviation of grain diameters)/(average grain diameter)}×100.

The silver halide grains may have a phase which is uniform all over the grain or phases differing from core to shell.

The preparation of the photographic emulsion to be used in the present invention can be accomplished by methods as described in P. Glfkides, *Chimie et Physique Photographique*, Paul Montel, 1967, G. F. Duffin, *Photographic Emulsion Chemistry*, The Focal Press, 1966, V. and L. Zelikman et al, *Making and Coating Photographic Emulsion*, The Focal Press, 1964.

The reaction of the soluble silver salt with the soluble halogen salt may be accomplished by a single jet process, a double jet process or a combination thereof.

It may also be accomplished by a method in which grains are formed in excess silver ions (so-called reverse mixing method). As one of the double jet processes there may be employed a method in which the pAg value of the liquid phase in which silver halide grains are formed is kept constant, i.e., a so-called controlled double jet process. Further, the formation of silver halide grains is preferably effected with a silver halide solvent such as ammonia, thiether and 4-substituted thiourea. More preferably, 4-substituted thiourea compounds are used. These compounds are described in JP-A-53-82408 and JP-A-55-77737. Preferred examples of thiourea compounds are tetramethylthiourea and 1,3-dimethyl-2-imidazolidinethione.

The controlled double jet process with a silver halide solvent facilitates the formation of a silver halide emulsion having a regular crystal form and a narrow grain size distribution. Thus, this process is useful for the preparation of the silver halide emulsion to be used in the present invention.

In order to obtain a uniform grain size, a method as described in British Patent 1,535,016, JP-B-48-36890 and JP-B-48-16364 which comprises changing the addition rate of silver nitrate or alkali halide according to the rate of grain formation or a method as described in British Patent 4,242,445 and JP-A-55-158124 which comprises changing the concentration of aqueous solution is preferably used to provide a rapid grain formation under the critical saturation point.

The silver halide grains to be used in the present invention may contain metallic atoms such as rhodium, iridium, iron, cobalt, nickel, ruthenium, palladium, platinum, gold, thallium, copper, lead and osmium, The amount of such a metallic atom to be incorporated is preferably in the range of $1\times10^{-9}$ to $1\times10^{-4}$ mol per mol of silver halide. These metallic atoms may be added during the preparation of the silver halide grains in the form of single salt, double salt or complex salt. In particular, a metallic atom such as rhodium and iridium is preferably incorporated into the silver halide grains to provide a high sensitivity and a high contrast.

As the rhodium compound to be used in the present invention there may be used a water-soluble rhodium compound. Examples of such a water-soluble rhodium compound include halogenated rhodium (III) compounds and rhodium complexes having halogen, amines, oxalate, etc. as ligands, such as hexachlororhodium (III) complex, hexabromorhodium (III) complex, hexaamminerhodium (III) complex and trioxalaterhodium (III) complex. These rhodium compounds may be dissolved in water or a proper solvent before use. In order to stabilize the rhodium compound solution, a commonly used method may be used, i.e., the addition of an aqueous solution of halogenated hydrogen (e.g., hydrochloric acid, bromic acid, fluoric acid) or halogenated alkali (e.g., KCl, NaCl, KBr, NaBr). Instead of using such a water-soluble rhodium, silver halide grains which have been previously doped with rhodium may be added and dissolved in the system during the preparation of the silver halide.

The total amount of the rhodium compound of the present invention to be added is preferably in the range of $1\times10^{-8}$ to $5\times10^{-6}$ mol, more preferably $5\times10^{-8}$ to $1\times10^{-6}$ mol, per mol of silver halide.

The addition of these compounds may be properly effected at various steps during the preparation of the silver halide emulsion grains and before the coating of the emulsion. In particular, these compounds are preferably added during the preparation of the emulsion so that they are incorporated into the silver halide grains.

As the iridium compound to be used in the present invention there may be used any iridium compound. Examples of such an iridium compound include hexachloroiridium, hexamine iridium, trioxalateiridium and hexacyanoiridium. These iridium compounds may be dissolved in water or a proper solvent before use. In order to stabilize the iridium compound solution, a commonly used method may be used, i.e., the addition of an aqueous solution of halogenated hydrogen (e.g., hydrochloric acid, bromic acid, fluoric acid) or halogenated alkali (e.g., KCl, NaCl, KBr, NaBr). Instead of using such a water-soluble iridium, silver halide grains which have been previously doped with iridium may be added and dissolved in the system during the preparation of the silver halide.

The total amount of the iridium compound of the present invention to be added is preferably in the range of $1\times10^{-8}$ to $5\times10^{-6}$ mol, more preferably $5\times10^{-8}$ to $1\times10^{-6}$ mol, per mol of silver halide.

The addition of these compounds may be properly effected at various steps during the preparation of the silver halide emulsion grains and before the coating of the emulsion. In particular, these compounds are preferably added during the preparation of the emulsion so that they are incorporated into the silver halide grains.

The silver halide emulsion of the present invention is preferably subjected to chemical sensitization. Any known chemical sensitization method such as sulfur sensitization, selenium sensitization, tellurium sensitization, reduction sensitization and gold senstization may be used singly or in combination.

As sulfur sensitizers to be used in the present invention there may be used sulfur compounds contained in gelatin as well as various sulfur compounds such as thiosulfate, thiourea, thiazole and rhodanine. Specific examples of such sulfur compounds include those described in U.S. Pat. Nos. 1,574,944, 2,278,947, 2,410,689, 2,728,668, 3,501,313, and 3,656,955. Preferred sulfur compounds are thiosulfates and thiourea compounds. The pAg value during the chemical sensitization process is preferably 8.3 or less, more preferably from 7.3 to 8.0. Further, as reported by Moisar, "Klein Gelatine", *Proc. Syme.* 2nd, 301–309 (1970), the combined use of polyvinyl and thiosulfate provides excellent results.

As a typical example of the noble metal sensitization process there can be used gold sensitization process. In the gold sensitization process, there is used a gold compound, mainly gold complex salt. Noble metals other than gold, such as platinum, palladium and rhodium can be included. Specific examples of such compounds are described in U.S. Pat. No. 2,448,060, and British Patent 618,061.

As sulfur sensitizers there may be used sulfur compounds contained in gelatin, various sulfur compounds such as thiosulfate, thiourea, thiazole and rhodanine, etc.

As reduction sensitizers there may be used stannous salts, amines, formamidinesulfinic acid, silane compounds, etc.

As selenium sensitizers to be used in the present invention there may be used selenium compounds as disclosed in the prior art patents. In particular, an instable selenium compound and/or stable selenium compound may be normally added to the emulsion which is then stirred at a temperature as high as 40° C. or higher for a predetermined period of time. As such an instable selenium compound there may be preferably used one described in JP-B-44-15748, JP-B-43-13489, JP-A-4-25832, and JP-A-4-109240. Specific examples of such instable selenium sensitizers include isoselenocyanates (e.g., aliphatic isoselenocyanates such as allylisoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-dimethoxybenzoyl) selenide), selenophosphates, phosphineselenides, and colloidal metallic selenium.

Preferred examples of instable selenium compounds have been described above, but these examples should not be construed as limiting. To those skilled in the art, the structure of the instable selenium compounds to be used as sensitizers for photographic emulsion is not so important so long as they are instable. It is generally understood that the organic moiety in the selenium sensitizer molecule does nothing but carry selenium and allows it to be present in the emulsion in an instable form. In the present invention, instable selenium compounds falling within such a wide concept can be used to advantage.

As the stable selenium compounds to be used in the present invention there may be used those described in JP-B-46-4553, JP-B-52-34492, and JP-B-52-34491. Specific examples of such stable selenium compounds include selenious acid, potassium selenocyanide, selenazoles, quaternary salts of selenazoles, diaryl selenide, diaryl diselenide, dialkyl selenide, dialkyl deselenide, 2-selenazolidine dione, 2-selenooxazoline thione, and derivatives thereof.

As tellurium sensitizers to be used in the present invention there may be preferably used the compounds described in U.S. Pat. Nos. 1,623,499, 3,320,069, and 3,772,031, British Patents 235,211, 1,121,496, 1,295,462, and 1,396,696, Canadian Patent 800,958, *Journal of Chemical Society Chemical Communication*, 635, 1980, ibid 1102 (1979), ibid 645 (1979), and *Journal of Chemical Society Perkin Transaction*, 1, 2191 (1980).

Specific examples of such tellurium sensitizers include colloidal tellurium, telluoroureas (e.g., allyltellurourea, N,N-dimethyltelluorurea, tetramethyltelluourea, N-carboxyethyl-N',N'-dimethyltelluorourea, N,N'-dimethylethylenetelluorourea, N,N'-diphenylethylenetellurourea), isotellurocyanates (e.g., allylisotellurocyanate), telluroketones (e.g., tellufoacetone, telluroacetophenone), telluroamides (e.g., telluroacetamide, N,N-dimethyltellurobenzamide), tellurohydrazide (e.g., N',N'-trimethyltellurobenzhydrazide), telluroester (e.g., t-butyl-t-hexyltelluroester), phosphine tellurides (e.g., tributylphosphine telluride, tricyclohexylphosphine telluride, triisopropylphosphine telluride, butyl-diisopropylphosphine telluride, dibutylphenylphosphine telluride), and other tellurium compounds (e.g., the negatively charged telluride ion-containing gelatin described in British Patent 1,295,462, potassium telluride, potassium tellurocyanate, sodium telluropentathionate, allyltellurocyanate).

In the present invention, as nucleation accelerators there may be preferably used amino compounds. Specific examples of such amino compounds include the compounds described in JP-A-2-103536 (compounds of general formulae (II-m) to (II-p) and (II-1) to (II-22) described in line 13, upper right column, page 9–line 10, upper left column, page 16), and compounds as described in JP-A-1-179939. Specific examples of these compounds are shown below, but the present invention should not be construed as being limited thereto.

Nucleation Accelerator (I)

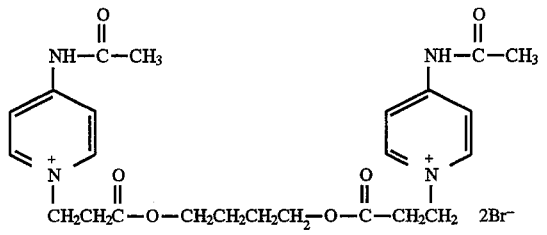

Nucleation Accelerator (II)

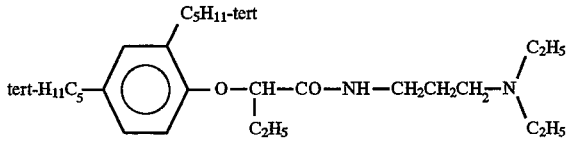

Nucleation Accelerator (III)

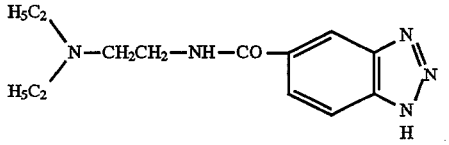

Nucleation Accelerator (IV)

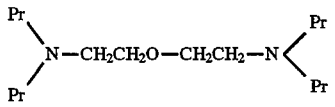

As a binder or protective colloid to be incorporated in to the hydrophilic emulsion there may be advantageously used gelatin. Other hydrophilic colloids may be used. Examples of such hydrophilic colloids which can be used in the present invention include protein such as gelatin derivatives, graft polymer of gelatin with other high molecular compounds, albumine, and casein, saccharide derivatives such as hydroxyethyl cellulose, carboxymethyl cellulose, cellulose ester sulfate, sodium alginate, and starch derivatives, monopolymers or copolymers such as polyvinyl alcohol, polyacrylic acid, polymethacrylic acid, polyacrylamide, polyvinyl imidazole, and polyvinyl pyrazole, and other various synthetic hydrophilic high molecular compounds.

In order to provide the silver halide photographic material of the present invention with an ultrahigh contrast and a high sensitivity, it is not necessary to use conventional infectious developers or highly alkaline developers having a pH value of 13 or so as described in U.S. Pat. No. 2,419,975. A stable developer is enough.

In particular, the silver halide photographic material of the present invention can provide a sufficiently ultrahigh negative image with a developer containing 0.15 mol/l or more of sulfurous ions as preservative and having a pH value of 9.6 to 11.0.

The developing agent to be incorporated into the developer to be used in the present invention is not specifically limited, but preferably contains dihydroxybenzenes, optionally in combination with 1-phenyl-3-pyrazolidones or p-aminophenols.

Examples of the dihydroxybenzene developing agent to be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Particularly preferred among these dihydroxybenzene developing agents is hydroquinone.

Examples of 1-phenyl-3-pyrazolidone and derivatives thereof to be used as developing agents include 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of the p-aminophenol developing agent to be used in the present invention include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Particularly preferred among these p-aminophenol developing agents is N-methyl-p-aminophenol.

In general, the developing agent is preferably used in an amount of 0.05 mol/l to 0.8 mol/l. When dihydroxybenzenes are used in combination with 1-phenyl-3-pyrazolidones or p-amino-phenoles, the former are preferably used in an amount of 0.05 mol/l to 0.5 mol/l, while the latter are preferably used in an amount of 0.06 mol/l or less.

Examples of sulfite preservatives to be used in the present invention include sodium sulfite, potassium sulfite, lithium sulfite, ammonium sulfite, sodium bisulfite, potassium metabisulifte, and sodium formaldehydebisulfite. The amount of the sulfite to be used is preferably in the range of 0.15 mol/l or more, particularly 0.3 mol/l or more. The upper limit of the amount of the sulfite to be used is preferably 2.5 mol/l.

The alkaline agent to be used for the pH adjustment contains a pH adjustor or buffer such as sodium hydroxide, potassium hydroxide, sodium carbonate, potassium carbonate, tribasic sodium phosphate and tribasic potassium phosphate. The pH value of the developer is set between 9.6 and 11.0.

Examples of additives which can be used other than the foregoing components include development inhibitors such as boric acid, borax, sodium bromide, potassium bromide and potassium bromide, organic solvents such as ethylene glycol, diethylene glycol, triethylene glycol, dimethylformamide, methylcellosolve, hexyleneglycol, ethanol and methanol, and fog inhibitors or black pepper inhibitors such as indazole compound (e.g., 1-phenyl-5-mercaptotetrazole, 5-nitroindazole) and benztriazole compound (e.g., 5-methylbenztriazole). The developer may further contain a color toner, a surface active agent, an anti-foaming agent, a water softener, a film hardener, and an amino compound as described in JP-A-56-106244 as necessary.

The developer of the present invention may contain a compound described in JP-A-56-24347 as a silver stain inhibitor. As the dissolution aid to be incorporated into the developer there may be used a compound described in Japanese Patent Application No. 60-109743. As the pH buffer to be incorporated into the developer there may be used a compound described in JP-A-60-93433 or Japanese Patent Application No. 61-28708.

As the fixing agent there may be used a composition commonly used. As such a fixing agent there may be used thiosulfate or thiocyanate as well as an organic sulfur compound known to serve as fixing agent. The fixing agent to be used in the present invention may contain a water-soluble aluminum compound (e.g., aluminum sulfate, alum) as a film hardener. The amount of such a water-soluble aluminum salt to be used is normally in the range of 0.4 to 2.0 g-Al/l. Further, ferric iron compounds may be used as oxidizers in the form of complex with ethylenediaminetetraacetic acid.

The development temperature may be normally between 18° C. and 50° C., preferably between 25° C. and 43° C.

Various additives to be incorporated into the photographic light-sensitive material of the present invention are not specifically limited. For example, those described below may be preferably used.

| Item | References |
|---|---|
| 1) Nucleation accelerator | Compounds of the general formulae (II), (III), (IV), (V) and (VI) described in Japanese Patent Application No. 4-237366; Compounds of the general formulae (II-m) to (II-p) and (II-1) to (II-22) described in line 13, upper right column, page 9 - line 10, upper left column, page 16 of JP-A-2-103536; compounds as described in JP-A-1-179939 |
| 2) Surface active agent | Line 7, upper right column, page 9 - line 7, lower right column, page 9 of JP-A-2-12236; line 13, lower left column, page 2 - line 18, lower right column page 4 of JP-A-2-18542 |
| 3) Fog Inhibitor | Line 19, lower right column, page 17 - line 4, upper right column, page 18 and line 1–line 5, lower right column, page 18 of JP-A-2-103536; thiosulfinic compounds as described in JP-A-1-237538 |
| 4) Polymer latex | Line 12–line 20, lower left column, page 18 of JP-A-2-103536 |
| 5) Acid group-containing compound | Line 6, lower right column, page 18 - line 1, upper right column, page 19 of JP-A-2-103536 |
| 6) Mat agent, lubricant, plasticizer | Line 15, upper left column, page 19 - line 15, upper right column, page 19 of JP-A-2-103536 |
| 7) Film hardener | Line 5–line 17, upper right column, page 18 of JP-A-2-103536 |
| 8) Dye | Dyes described in line 1–line 18, lower right column, page 17 of JP-A-2-103536; solid dyes described in JP-A-2-294638 and JP-A-5-11382 |
| 9) Binder | Line 1–line 20, lower right column, page 3 of JP-A-2-18542 |
| 10) Pepper fog inhibitor | Compounds described in U.S. Pat. No. 4,956,257 and JP-A-1-118832 |
| 11) Redox compound | Compounds of general formula (I) (particularly Exemplary Compounds 1 to 50) as described in JP-A-2-301743; Compounds of the general formulae (R-1), (R-2) and (R-3) Exemplary Compounds 1 to 75 described in JP-A-3-174143, pp. 3–20; |

-continued

| Item | References |
|---|---|
| | compounds described in Japanese Patent Application Nos. 3-69466 and 3-15648 |
| 12) Monomethine compound | Compounds of general formula (II) (particularly Exemplary Compounds II-1 to II-26) as described in JP-A-2-287532 |
| 13) Dihydroxybenzenes | Compounds described in JP-A-3-39948, upper left column, page 11 - lower left column, page 12, and EP452772A |

The present invention will be further described in the following examples, but the present invention should not be construed as being limited thereto.

EXAMPLE 1

Emulsions A and B Were prepared as follows:

Emulsion A:

An aqueous solution of 0.13M silver nitrate and an aqueous solution of halogen salts containing $K_2Rh(H_2O)Cl_5$ in an amount of $1.5\times10^{-7}$ mol per mol of silver, $K_3IrCl_6$ in an amount of $2\times10^{-7}$ mol per mol of silver, 0.04M potassium bromide and 0.09M sodium chloride were added to an aqueous solution of gelatin containing sodium chloride and 1,3-dimethyl-2-imidazolidinethione with stirring at a temperature of 38° C. over 12 minutes in a double jet process to prepare silver bromochloride grains having an average grain size of 0.14 μm and a silver chloride content of 70 mol %. Thus, nuclei were formed. Then, an aqueous solution of 0.87M silver nitrate and an aqueous solution of halogen salts containing 0.26M potassium bromide and 0.65M sodium chloride were similarly added to the system over 20 minutes in a double jet process.

The emulsion system was then subjected to conversion with $1\times10^{-3}$ mol of KI solution. The emulsion was then washed with water by an ordinary flocculation method. Forty g of gelatin was added to the system. The system was then adjusted to a pH value of 6.5 and a pAg value of 7.5. The emulsion was then kept to a temperature of 60° C. Sensitizing dyes of the present invention and comparative compounds as mentioned below were then added to the emulsion in an amount of $5\times10^{-4}$ mol per mol of silver, respectively, as set forth in Table 1. Sodium benzenethiosulfonate, benzenesulfinic acid, chloroauric acid, potassium thiocyanate and sodium thiosulfate were then added to the system in amounts of 7 mg, 2 mg, 8 mg, 200 mg and 5 mg per mol of silver, respectively. The system was heated to a temperature of 60° C. for 45 minutes so that it was chemically sensitized. One hundred fifty mg of 4-hydroxy-6-methyl-1,3,3a,7-tetrazaindene as a stabilizer and 100 mg of Proxel as an antiseptic were added to the system. As a result, an emulsion of cubic silver bromochloroiodide grains having an average size of 0.25 μm and a silver chloride content of 69.9 mol % was obtained (fluctuation coefficient: 10%).

Emulsion B:

An aqueous solution of 0.13M silver nitrate and an aqueous solution of halogen salts containing $K_2Rh(H_2O)Cl_5$ in an amount of $1.5\times10^{-7}$ mol per mol of silver, $K_3IrCl_6$ in an amount of $2\times10^{-7}$ mol per mol of silver, 0.09M potassium bromide and 0.04M sodium chloride were added to an aqueous solution of gelatin containing sodium chloride and 1,3-dimethyl-2-imidazolidinethione with stirring at a temperature of 38° C. over 12 minutes in a double jet process to prepare silver bromochloride grains having an average grain size of 0.13 μm and a silver chloride content of 30 mol %. Thus, nuclei were formed. Then, an aqueous solution of 0.87M silver nitrate and an aqueous solution of halogen salts containing 0.61M potassium bromide and 0.30M sodium chloride were similarly added to the system over 20 minutes over a double jet process.

The emulsion system was then subjected to conversion with $1\times10^{-3}$ mol of KI solution. The emulsion was then washed with water by an ordinary flocculation method. Forty g of gelatin was added to the system. The system was then adjusted to a pH value of 6.5 and a pAg value of 7.5. The emulsion was then kept to a temperature of 60° C. Sensitizing dyes of the present invention and comparative compounds as mentioned below were then added to the emulsion in an amount of $5\times10^{-4}$ mol per mol of silver, respectively, as set forth in Table 1. Sodium benzenethiosulfonate, benzenesulfinic acid, chloroauric acid, potassium thiocyanate and sodium thiosulfate were then added to the system in amounts of 7 mg, 2 mg, 8 mg, 200 mg and 5 mg per mol of silver, respectively. The system was heated to a temperature of 60° C. for 45 minutes so that it was chemically sensitized. One hundred fifty rag of 4-hydroxy-6-methyl-1,3,3a,7-tetrazaindene as a stabilizer and 100 mg of Proxel as an antiseptic were added to the system. As a result, an emulsion of cubic silver broraochloroiodide grains having an average size of 0.25 μm and a silver chloride content of 29.9 mol % was obtained (fluctuation coefficient: 10%).

Comparitive Dye

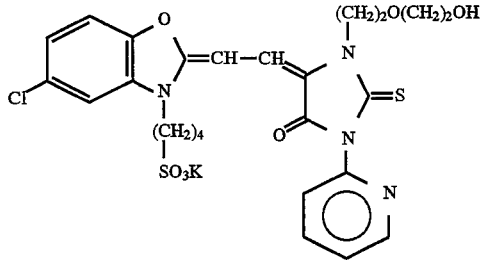

Preparation of coat specimen

To the emulsion was added a compound of the general formula (7) of the present invention or comparative compound (a) as set forth in Table 1. To the emulsion were then added 5-chloro-8-hydroxyquinoline and a compound having Structural Formula (b) as shown below in amounts of $2\times10^{-3}$ mol and $3\times10^{-4}$ mol per mol of silver, respectively. To the emulsion was then added a hydrazine compound of the present invention in an amount of $4\times10^{-4}$ mol per mol of silver or Comparative Nucleating Agent (c) in an amount of $3\times10^{-3}$ mol as set forth in Table 1. To the emulsion was then added N-oleyl-N-methyltaurine sodium in such an amount that the coated amount thereof was 30 mg/m$^2$. To the emulsion were then added a water-soluble latex represented by Structural Formula (b) as shown below, a 88:5:7 (by weight) latex copolymer of methyl acrylate, sodium 2-acrylamide-2-methylpropanesulfonate and 2-acetoacetoxyethyl methacrylate, and 1,3-divinylsulfonyl-2-propanol as a film hardener in amounts of 200 mg/m$^2$, 200 mg/m$^2$ and 200 mg/m$^2$, respectively. The pH value of the solution was adjusted to 6.0. The coating solution was then coated on a polyethylene terephthalate film having a moisture barrier containing vinylidene chloride in such an amount that the coated amount of silver reached 3.0 g/m$^2$ (gelatin: 1.4 g/m$^2$).

Comparative Compound (a)

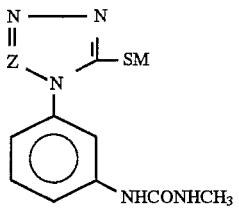

Structural Formula (b)

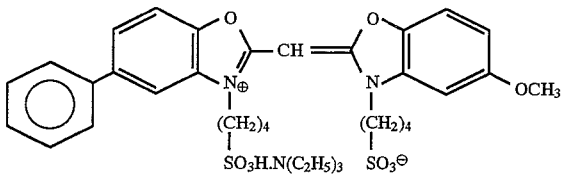

Comparative Nucleating Agent (c)

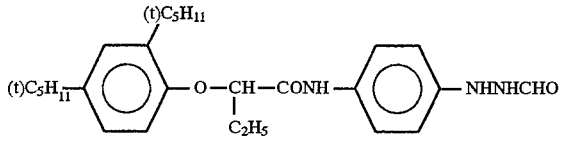

Water-soluble Latex (d)

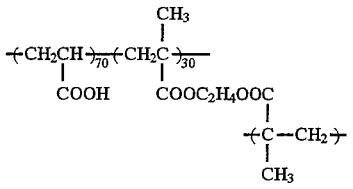

On the emulsion layer were coated 1.0 g/m$^2$ of gelatin, 40 mg/m$^2$ of an amorphous $SiO_2$ mat agent having an average grain size of about 3.5 μm, 0.1 g/m$^2$ of colloidal silica (Snowrex C colloidal silica produced by Nissan Kagaku Co. Ltd.), 100 mg/m$^2$ of a polyacrylamide and 20 mg/m$^2$ of a silicone oil as protective layer components and 5 mg/m$^2$ of a fluorine surface active agent having Structural Formula (e) shown below and 100 mg/m$^2$ of sodium dodecylbenzenesulfonate as coating aids. Thus, specimens were prepared as set forth in Table 1.

Structural Formula (e)

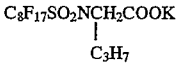

TABLE 1

| Specimen No. | E-mulsion | Dye | Nucleating (hydrazine compound) | Compound of general formula (7) Kind | Compound of general formula (7) Added amount (mol/mol Ag) |
|---|---|---|---|---|---|
| 1-1 | A | 1-Q | 3-1 | 7-4 | $1 \times 10^{-4}$ |
| 1-2 | A | 1-Q | 3-1 | 7-11 | $3 \times 10^{-4}$ |
| 1-3 | A | 1-Q | 3-1 | 7-27 | $5 \times 10^{-4}$ |
| 1-4 | A | 1-Q | 3-3 | 7-11 | $3 \times 10^{-4}$ |
| 1-5 | A | 1-Q | 3-10 | 7-11 | $3 \times 10^{-4}$ |
| 1-6 | A | 1-Q | 4-9 | 7-11 | $3 \times 10^{-4}$ |
| 1-7 | A | 1-Q | 5-1 | 7-11 | $3 \times 10^{-4}$ |
| 1-8 | A | 2-B | 3-1 | 7-11 | $3 \times 10^{-4}$ |
| 1-9 | A | 2-B | 3-1 | 7-27 | $5 \times 10^{-4}$ |
| 1-10 | A | 2-B | 3-3 | 7-11 | $3 \times 10^{-4}$ |
| 1-11 | B | 1-Q | 3-1 | 7-11 | $3 \times 10^{-4}$ |
| 1-12 | A | Comparative | 3-1 | 7-11 | $3 \times 10^{-4}$ |
| 1-13 | A | 1-Q | Comparative (c) | 7-11 | $3 \times 10^{-4}$ |
| 1-14 | A | 1-Q | 3-1 | — | $3 \times 10^{-4}$ |
| 1-15 | A | 1-Q | 4-1 | (a) | $5 \times 10^{-4}$ |

The back layer and back protective layer were prepared in accordance with the following formulations:

| (Back layer) | |
|---|---|
| Gelatin | 3 g/m$^2$ |
| Latex: polyethyl acrylate | 2 g/m$^2$ |
| Surface active agent: sodium p-dodecylbenzehesulfonate | 40 mg/m$^2$ |
| Film hardener: 1,2-bis(vinylsulfonylacetamide)ethane | 110 mg/m$^2$ |
| $SnO_2$/Sb (weight ratio: 90/10; average grain diameter: 0.20 μm) | 200 mg/m$^2$ |
| Dye (f) | 50 mg/m$^2$ |
| Dye (g) | 100 mg/m$^2$ |
| Dye (h) | 50 mg/m$^2$ |

Dye (f)

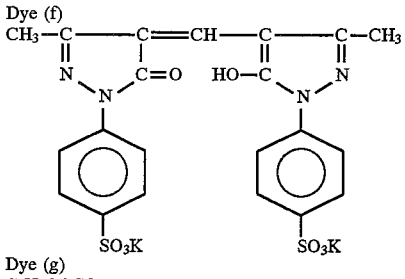

Dye (g)

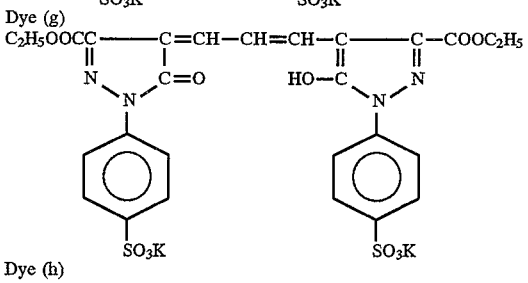

Dye (h)

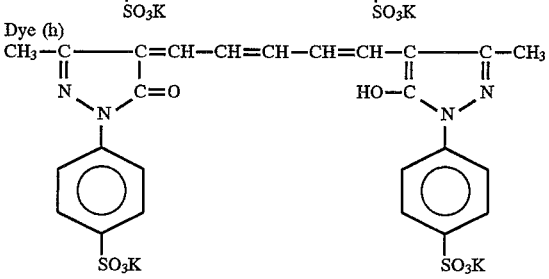

These specimens were each exposed to light from a tungsten lamp through a step wedge, and then processed with a developer having the following composition and GR-F1 (available from Fuji photo Film Co., Ltd.) as a fixing solution at a temperature of 35° C. for 30 seconds in an automatic developing machine FG-680A (available from Fuji photo Film Co., Ltd.). The results of the evaluation are set forth in Table 2.

| Developer 1 | |
|---|---|
| Replenisher: | |
| Sodium 1,2-dihydroxybenzene-3,5-disulfonate | 0.5 g |
| Diethylenetriaminepentaacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-Hexahydro-2-thioxo-4-(1H)-quinazolinone | 0.09 g |
| Sodium 2-mercaptobenzimidazole-5-sulfonate | 0.3 g |
| Water to make | 1 l |
| pH (adjusted with potassium hydroxide) | 10.7 |
| Starter: | |
| 90% Acetic acid | 366 g |
| Water to make | 1 l |

To 1 l of the replenisher was added 10 ml of the starter to prepare Developer 1.

Developer 2

Exposed specimens (percent blackening: 100%) were each subjected to continuous processing (running test) with Developer 1 without replenishment in an amount corresponding to 30 sheets having 20×24 inch. Thus, Developer 2 was prepared.

Developer 3

Developer 1 was allowed to stand without replenishment at a temperature of 38° C. for 1 month. Thus, Developer 3 was prepared.

Sensitivity is represented by the logarithm of the reciprocal of the exposure at which development at 35° C. for 30 seconds gives a density of 1.5 relative to the value of Specimen 1-1 as 1. The higher this value is, the higher is the sensitivity. The value γ is represented by the following equation:

$$\gamma = \frac{3.0 - 0.3}{\log(\text{exposure giving a density of } 3.0) - \log(\text{exposure giving a density of } 0.3)}.$$

The black pepper (pepper fog) was subjected to -step evaluation by observing the developed portion under microscope. In the 5-step evaluation, Step "5" is excellent, and Step "1" is poor. Steps "5" and "4" are practicable. Step "3" is the lowest practicable level. Steps "2" and "1" are impracticable levels.

Further, a simulation test on the stability after prolonged storage was conducted. Specimens which were allowed to stand at a temperature of 25° C. and a relative humidity of 55% for 7 days (Condition 1). Another batch of these specimens were moisture-conditioned in an atmosphere of a temperature of 25° C. and a relative humidity of 40% for 2 hours, heat-sealed under the same conditions, and then allowed to stand at a temperature of 40° C. for 20 days (Condition 2). These specimens were then subjected to the same evaluation as that of photographic properties. The sensitivity was represented by the logarithm of the reciprocal of the exposure at which 35° C.—30 second development with Developer 1 gives a density of 1.5. The degree of sensitivity variation was represented by ΔlogE obtained by subtracting the sensitivity value of the specimen under Condition 1 from that of the specimen under Condition 2. The higher ΔlogE is, the higher is the sensitization after prolonged storage.

TABLE 2

| Specimen | Developer 1 | | Developer 2 | | Developer 3 | Prolonged storage | |
|---|---|---|---|---|---|---|---|
| No. | Sensitivity | γ | Sensitivity | γ | Black pepper | stability ΔlogE | Black Pepper |
| 1-1 | 1.00 | 19 | 0.92 | 17 | 4 | 0.08 | 4 |
| 1-2 | 1.05 | 19 | 0.98 | 17 | 4 | 0.07 | 3 |
| 1-3 | 1.05 | 19 | 0.98 | 17 | 4 | 0.07 | 3 |
| 1-4 | 1.02 | 20 | 0.94 | 18 | 3 | 0.08 | 3 |
| 1-5 | 1.05 | 19 | 0.97 | 17 | 4 | 0.08 | 4 |
| 1-6 | 1.06 | 18 | 0.98 | 16 | 4 | 0.07 | 4 |
| 1-7 | 1.02 | 18 | 0.95 | 16 | 4 | 0.07 | 3 |
| 1-8 | 1.03 | 19 | 0.96 | 17 | 4 | 0.08 | 4 |
| 1-9 | 1.00 | 18 | 0.92 | 16 | 4 | 0.08 | 4 |
| 1-10 | 1.03 | 19 | 0.95 | 17 | 3 | 0.08 | 3 |
| 1-11 | 1.10 | 15 | 0.90 | 10 | 2 | 0.06 | 2 |
| 1-12 | 1.08 | 19 | 0.90 | 14 | 1 | 0.08 | 1 |
| 1-13 | 0.85 | 7 | 0.82 | 7 | 5 | 0.05 | 5 |
| 1-14 | 1.05 | 18 | 0.85 | 12 | 3 | 0.15 | 1 |
| 1-15 | 1.00 | 19 | 0.93 | 17 | 4 | 0.07 | 2 |

(Note) Specimens 1-1 to 1-10 are according to the present invention while the others are comparative.

Table 2 shows that Specimens 1-1 to 1-10, prepared according to the present invention, exhibit an excellent sensitivity and γ value, little change in sensitivity and γ value from Developer 1 to Developer 2, insiginficant black pepper phenomenon, and an excellent stability to prolonged storage. It is also shown that Specimens 1-11 and 1-12, prepared from Emulsion B having a less silver chloride content and comparative dyes, exhibit a greater change in sensitivity and γ value from Developer 1 to Developer 2, and significant black pepper phenomenon, while Specimen 1-2 prepared from the emulsion and dye of the present invention, exhibits excellent properties. Specimen 1-13, prepared from the comparative nucleating agent, exhibits a low γ value and insufficient contrast.

It is further shown that Specimen 1-14, prepared without a compound represented by general formula (7), exhibits a greater change in sensitivity and γ value and a poor stability to prolonged storage. The results show that the use of a compound represented by general formula (7) provides drastically improvement in these properties.

EXAMPLE 2

Specimens were prepared in the same manner as in Example 1, except that a compound represented by general formula (8) set forth in Table 3 was used instead of the compound represented by general formula (7). The evaluation was made in the same manner as in Example 1. The sensitivity was determined relative to that of Specimen 2-1 as 1.

The results are set forth in Table 3. As in Example 1, Specimens 2-1 to 2-12, prepared according to the present invention, exhibited excellent properties.

The comparison with Specimen 2-16 shows that the use of a compound represented by general formula (8) provides improvement in properties such as sensitivity change, γ change and stability to prolonged storage.

evaluation was made in the same manner as in Example 1. The sensitivity was determined relative to that of Specimen 3-1 as 1.

The results are set forth in Table 4. As in Example 1, Specimens 3-1 to 3-15, prepared according to the present invention, exhibited excellent properties.

TABLE 3

| Specimen No. | Emulsion | Dye | Nucleating Agent | Compound (8) Kind | Compound (8) Added Amount* | Developer 1 Sensitivity | Developer 1 γ | Developer 2 Sensitivity | Developer 2 γ | Developer 3 Black pepper | Stability to Prolonged Storage ΔlogE | Black pepper | Remarks |
|---|---|---|---|---|---|---|---|---|---|---|---|---|---|
| 2-1 | A | 1-Q | 4-1 | 8-2 | $3 \times 10^{-4}$ | 1.00 | 19 | 0.91 | 17 | 4 | 0.08 | 3 | |
| 2-2 | A | 1-Q | 4-1 | 8-4 | $3 \times 10^{-4}$ | 1.02 | 19 | 0.94 | 17 | 4 | 0.07 | 4 | |
| 2-3 | A | 1-S | 4-1 | 8-2 | $3 \times 10^{-4}$ | 0.97 | 18 | 0.88 | 16 | 4 | 0.08 | 3 | |
| 2-4 | A | 1-S | 4-1 | 8-4 | $3 \times 10^{-4}$ | 1.00 | 18 | 0.92 | 16 | 4 | 0.07 | 4 | |
| 2-5 | A | 2-B | 4-1 | 8-2 | $3 \times 10^{-4}$ | 0.98 | 19 | 0.90 | 17 | 4 | 0.08 | 4 | |
| 2-6 | A | 2-B | 4-1 | 8-4 | $3 \times 10^{-4}$ | 1.00 | 19 | 0.91 | 17 | 4 | 0.07 | 4 | |
| 2-7 | A | 2-B | 4-3 | 8-4 | $3 \times 10^{-4}$ | 1.03 | 19 | 0.95 | 17 | 4 | 0.08 | 4 | Present Invention |
| 2-8 | A | 2-B | 4-10 | 8-4 | $3 \times 10^{-4}$ | 1.05 | 19 | 0.97 | 17 | 3 | 0.08 | 3 | |
| 2-9 | A | 2-B | 5-9 | 8-4 | $3 \times 10^{-4}$ | 1.03 | 19 | 0.95 | 17 | 4 | 0.07 | 4 | |
| 2-10 | A | 2-13 | 6-1 | 8-4 | $3 \times 10^{-4}$ | 1.00 | 19 | 0.92 | 17 | 4 | 0.07 | 3 | |
| 2-11 | A | 3-u | 4-1 | 8-2 | $3 \times 10^{-4}$ | 1.05 | 19 | 0.97 | 17 | 4 | 0.08 | 4 | |
| 2-12 | A | 3-u | 4-1 | 8-4 | $3 \times 10^{-4}$ | 1.07 | 19 | 0.99 | 17 | 4 | 0.07 | 4 | |
| 2-13 | B | 1-Q | 4-1 | 8-4 | $3 \times 10^{-4}$ | 1.10 | 16 | 0.90 | 10 | 2 | 0.06 | 2 | |
| 2-14 | A | Comparison | 4-1 | 8-4 | $3 \times 10^{-4}$ | 1.05 | 20 | 0.88 | 14 | 1 | 0.08 | 1 | Comparative |
| 2-15 | A | 1-Q | Comparison | 8-4 | $3 \times 10^{-4}$ | 0.85 | 7 | 0.82 | 7 | 5 | 0.05 | 5 | |
| 2-16 | A | 1-Q | 3-1 | — | — | 1.05 | 18 | 0.85 | 12 | 3 | 0.15 | 1 | |

*Mol/mol · Ag

EXAMPLE 3

Specimens were prepared in the same manner as in Example 1, except that a compound represented by the general formula (9) set forth in Table 4 was used instead of the compound represented by general formula (7). The The comparison with Specimen 3-19 shows that the use of a compound represented by general formula (9) provides improvements in properties such as sensitivity change, γ change and stability to prolonged storage.

TABLE 4

| Specimen No. | Emulsion | Dye | Nucleating Agent | Compound (8) Kind | Compound (8) Added Amount (mg/m²) | Developer 1 Sensitivity | Developer 1 γ | Developer 2 Sensitivity | Developer 2 γ | Developer 3 Black pepper | Stability to Prolonged Storage ΔlogE | Black pepper | Remarks |
|---|---|---|---|---|---|---|---|---|---|---|---|---|---|
| 3-1 | A | 1-Q | 4-1 | 9-1 | 50 | 1.00 | 19 | 0.90 | 17 | 4 | 0.07 | 3 | Present Invention |
| 3-2 | A | 1-Q | 4-1 | 9-1 | 100 | 0.98 | 19 | 0.90 | 17 | 4 | 0.06 | 4 | Present Invention |
| 3-3 | A | 1-Q | 4-1 | 9-8 | 50 | 0.98 | 19 | 0.89 | 17 | 4 | 0.08 | 3 | Present Invention |
| 3-4 | A | 2-B | 4-1 | 9-1 | 50 | 0.98 | 18 | 0.90 | 16 | 4 | 0.07 | 4 | Present Invention |
| 3-5 | A | 2-B | 4-1 | 9-8 | 50 | 0.96 | 18 | 0.88 | 16 | 4 | 0.07 | 3 | Present Invention |
| 3-6 | A | 1-Q | 4-3 | 9-1 | 50 | 1.02 | 19 | 0.94 | 17 | 4 | 0.07 | 4 | Present Invention |
| 3-7 | A | 1-Q | 4-10 | 9-1 | 50 | 1.02 | 19 | 0.93 | 16 | 4 | 0.07 | 4 | Present Invention |
| 3-8 | A | 1-Q | 5-9 | 9-1 | 50 | 1.00 | 19 | 0.92 | 17 | 3 | 0.07 | 3 | Present Invention |
| 3-9 | A | 1-Q | 6-1 | 9-1 | 50 | 1.02 | 19 | 0.93 | 17 | 4 | 0.08 | 4 | Present Invention |
| 3-10 | A | 2-B | 4-10 | 9-1 | 50 | 1.00 | 18 | 0.92 | 16 | 4 | 0.07 | 4 | Present Invention |

TABLE 4-continued

| Specimen No. | Emulsion | Dye | Nucleating Agent | Compound (8) Kind | Compound (8) Added Amount (mg/m²) | Developer 1 Sensitivity | Developer 1 γ | Developer 2 Sensitivity | Developer 2 γ | Developer 3 Black pepper | Stability to Prolonged Storage ΔlogE | Black pepper | Remarks |
|---|---|---|---|---|---|---|---|---|---|---|---|---|---|
| 3-11 | A | 3-c | 4-1 | 9-1 | 50 | 1.05 | 19 | 0.97 | 17 | 4 | 0.08 | 4 | Present Invention |
| 3-12 | A | 3-u | 4-1 | 9-1 | 50 | 1.05 | 19 | 0.98 | 17 | 4 | 0.08 | 4 | Present Invention |
| 3-13 | A | 3-w | 4-1 | 9-1 | 50 | 1.02 | 19 | 0.94 | 17 | 4 | 0.07 | 4 | Present Invention |
| 3-14 | A | 3-w | 5-9 | 9-1 | 50 | 1.02 | 19 | 0.94 | 17 | 3 | 0.08 | 3 | Present Invention |
| 3-15 | A | 3-w | 6-1 | 9-1 | 50 | 1.02 | 19 | 0.94 | 17 | 4 | 0.07 | 4 | Present Invention |
| 3-16 | B | 1-Q | 4-1 | 9-1 | 50 | 1.10 | 16 | 0.90 | 10 | 2 | 0.06 | 2 | Comparative |
| 3-17 | A | Comparison | 4-1 | 9-1 | 50 | 1.05 | 20 | 0.88 | 14 | 1 | 0.07 | 1 | Comparative |
| 3-18 | A | 1-Q | Comparison | 9-1 | 50 | 0.80 | 7 | 0.77 | 7 | 5 | 0.05 | 5 | Comparative |
| 3-19 | A | 1-Q | 4-1 | — | — | 1.00 | 18 | 0.80 | 12 | 3 | 0.15 | 1 | Comparative |

EXAMPLE 4

Specimens were prepared in the same manner as in Example 1, except that the compounds represented by one of general formulae (10), (11) and (12) set forth in Table 5 were added to the protective layer coating solution instead of the compound represented by general formula (7) to be incorporated into the emulsion layer. The evaluation was made in the same manner as in Example 1. The sensitivity was determined relative to that of Specimen 4-1 as 1.

The results are set forth in Table 5. As in Example 1, Specimens 4-1 to 4-12, prepared according to the present invention, exhibited excellent properties.

The comparison with Specimen 4-16 shows that the use of the compounds represented by the general formula (10), (11) and (12) provides improvement in properties such as sensitivity change, γ change and stability to prolonged storage.

TABLE 5

| Specimen No. | Emulsion | Dye | Nucleating Agent | Compounds (10), (11), (12) Kind | Compounds (10), (11), (12) Added Amount (mg/m²) | Developer 1 Sensitivity | Developer 1 γ | Developer 2 Sensitivity | Developer 2 γ | Developer 3 Black pepper | Stability to Prolonged Storage ΔlogE | Black pepper | Remarks |
|---|---|---|---|---|---|---|---|---|---|---|---|---|---|
| 4-1 | A | 1-Q | 4-1 | T-1 | 5 | 1.00 | 19 | 0.92 | 17 | 4 | 0.08 | 3 | Present Invention |
| 4-2 | A | 1-Q | 4-1 | T-15 | 5 | 0.98 | 19 | 0.90 | 17 | 4 | 0.07 | 4 | Present Invention |
| 4-3 | A | 1-Q | 4-3 | T-1 | 5 | 1.02 | 19 | 0.94 | 17 | 4 | 0.07 | 4 | Present Invention |
| 4-4 | A | 1-Q | 4-3 | T-15 | 5 | 1.00 | 19 | 0.92 | 17 | 4 | 0.07 | 4 | Present Invention |
| 4-5 | A | 1-Q | 5-9 | T-1 | 5 | 1.02 | 19 | 0.94 | 16 | 4 | 0.08 | 3 | Present Invention |
| 4-6 | A | 1-Q | 5-9 | T-15 | 5 | 1.00 | 19 | 0.91 | 17 | 4 | 0.07 | 4 | Present Invention |
| 4-7 | A | 1-Q | 4-10 | T-15 | 5 | 1.02 | 18 | 0.94 | 16 | 3 | 0.07 | 3 | Present Invention |
| 4-8 | A | 1-Q | 6-1 | T-15 | 5 | 1.02 | 19 | 0.94 | 17 | 4 | 0.07 | 4 | Present Invention |
| 4-9 | A | 2-B | 4-1 | T-1 | 5 | 0.98 | 18 | 0.90 | 17 | 4 | 0.07 | 4 | Present Invention |
| 4-10 | A | 2-B | 4-1 | T-15 | 5 | 0.96 | 18 | 0.88 | 17 | 4 | 0.07 | 4 | Present Invention |
| 4-11 | A | 3-u | 6-1 | T-15 | 5 | 1.05 | 19 | 0.97 | 17 | 4 | 0.08 | 4 | Present Invention |
| 4-12 | A | 3-u | 6-1 | T-15 | 5 | 1.02 | 19 | 0.97 | 17 | 4 | 0.08 | 4 | Present Invention |
| 4-13 | B | 1-Q | 4-1 | T-15 | 5 | 1.10 | 16 | 0.90 | 10 | 2 | 0.06 | 2 | Comparative |
| 4-14 | A | Comparison | 4-1 | T-15 | 5 | 1.05 | 20 | 0.88 | 14 | 1 | 0.08 | 1 | Comparative |

TABLE 5-continued

| Specimen No. | Emulsion | Dye | Nucleating Agent | Compounds (10), (11), (12) Kind | Added Amount (mg/m²) | Developer 1 Sensitivity | γ | Developer 2 Sensitivity | γ | Developer 3 Black pepper | Stability to Prolonged Storage ΔlogE | Black pepper | Remarks |
|---|---|---|---|---|---|---|---|---|---|---|---|---|---|
| 4-15 | A | 1-Q | Comparison | T-15 | 5 | 0.80 | 7 | 0.77 | 7 | 5 | 0.05 | 5 | Comparative |
| 4-16 | A | 1-Q | 4-1 | — | — | 1.03 | 18 | 0.83 | 12 | 3 | 0.15 | 1 | Comparative |

EXAMPLE 5

Emulsions were prepared in the same manner as in Emulsion A of Example 1, except that to an emulsion comprising Sensitizing Dye 1-Q of the present invention in an amount of $5\times10^{-4}$ mol per mol of silver were added compounds (7) to (9) of the present invention set forth in Table 6 and then 5-chloro-8-hydroxyquinoline in an amount of $2\times10^{-3}$ mol per mol of silver, the compound having Structural Formula (b) in an amount of $3\times10^{-4}$ mol per mol of silver and Compound 4-1 as a hydrazine a compound of the present invention in an amount of $4\times10^{-4}$ mol per mol of silver.

To the emulsion were then added the same components as in Example 1, beginning with N-oleyl-N-methyltaurine sodium and ending with the film hardener. The emulsion was then coated on a support. A protective layer was coated in the same manner as in Example 1, except that the compounds represented by one of the general formulae (10) to (12) of the present invention were added as set forth in Table 6. A back layer and a back protective layer were coated in the same manner as in Example 1. Thus, specimens were prepared as set forth in Table 6.

These specimens were then evaluated in the same manner as in Example 1. The sensitivity was determined relative to that of Specimen 5-1 as 1. The results are set forth in Table 7.

TABLE 6

| Specimen No. | Compound (7) Kind | Compound (7) Added amount (Mol/mol.Ag) | Compound (8) Kind | Compound (8) Added amount (Mol/mol.Ag) | Compound (9) Kind | Compound (9) Added amount (mg/m²) | Compounds (10), (11), (12) Kind | Compounds (10), (11), (12) Added amount (mg/m²) | Remarks |
|---|---|---|---|---|---|---|---|---|---|
| 5-1 | — | — | — | — | — | — | — | — | Compartive |
| 5-2 | 7-9 | $3\times10^{-4}$ | — | — | — | — | — | — | Present Invention |
| 5-3 | — | — | 8-4 | $3\times10^{-4}$ | — | — | — | — | Present Invention |
| 5-4 | — | — | — | — | 9-1 | 50 | — | — | Present Invention |
| 5-5 | — | — | — | — | — | — | T-15 | 5 | Present Invention |
| 5-6 | 7-9 | $3\times10^{-4}$ | 8-4 | $3\times10^{-4}$ | — | — | — | — | Present Invention |
| 5-7 | 7-9 | $3\times10^{-4}$ | — | — | 9-1 | 50 | — | — | Present Invention |
| 5-8 | 7-9 | $3\times10^{-4}$ | — | — | — | — | T-15 | 5 | Present Invention |
| 5-9 | — | — | 8-4 | $3\times10^{-4}$ | 9-1 | 50 | — | — | Present Invention |
| 5-10 | — | — | 8-4 | $3\times10^{-4}$ | — | — | T-15 | 5 | Present Invention |
| 5-11 | — | — | — | — | 9-1 | 50 | T-15 | 5 | Present Invention |
| 5-12 | 7-9 | $3\times10^{-4}$ | 8-4 | $3\times10^{-4}$ | 9-1 | 50 | — | — | Present Invention |
| 5-13 | 7-9 | $3\times10^{-4}$ | 8-4 | $3\times10^{-4}$ | — | — | T-15 | 5 | Present Invention |
| 5-14 | 7-9 | $3\times10^{-4}$ | — | — | 9-1 | 50 | T-15 | 5 | Present Invention |
| 5-15 | — | — | 8-4 | — | 9-1 | 50 | T-15 | 5 | Present Invention |
| 5-16 | 7-9 | $3\times10^{-4}$ | 8-4 | $3\times10^{-4}$ | 9-1 | 50 | T-15 | 5 | Present Invention |

TABLE 7

| | Developer 1 | | Developer 2 | | Developer 3 | Prolonged storage stability | |
|---|---|---|---|---|---|---|---|
| Specimen No. | Sensitivity | γ | Sensitivity | γ | Black pepper | ΔlogE | Black Pepper |
| 5-1 | 1.00 | 18 | 0.80 | 12 | 3 | 0.15 | 1 |
| 5-2 | 1.00 | 19 | 0.92 | 17 | 4 | 0.07 | 4 |
| 5-3 | 0.97 | 19 | 0.89 | 17 | 4 | 0.07 | 4 |
| 5-4 | 1.00 | 19 | 0.90 | 17 | 4 | 0.07 | 4 |
| 5-5 | 0.95 | 19 | 0.87 | 17 | 4 | 0.07 | 4 |
| 5-6 | 0.98 | 19 | 0.92 | 17 | 5 | 0.05 | 5 |
| 5-7 | 1.00 | 19 | 0.93 | 17 | 4 | 0.04 | 4 |
| 5-8 | 0.96 | 20 | 0.90 | 18 | 4 | 0.05 | 4 |
| 5-9 | 0.97 | 19 | 0.90 | 17 | 4 | 0.04 | 4 |
| 5-10 | 0.93 | 20 | 0.87 | 18 | 4 | 0.05 | 4 |
| 5-11 | 0.95 | 19 | 0.88 | 17 | 4 | 0.04 | 4 |
| 5-12 | 0.97 | 19 | 0.92 | 18 | 5 | 0.03 | 5 |
| 5-13 | 0.94 | 20 | 0.89 | 19 | 5 | 0.03 | 5 |
| 5-14 | 0.96 | 19 | 0.91 | 17 | 4 | 0.02 | 4 |
| 5-15 | 0.93 | 20 | 0.88 | 18 | 5 | 0.03 | 5 |
| 5-16 | 0.93 | 20 | 0.90 | 19 | 5 | 0.02 | 5 |

Table 7 shows that the use of the compounds represented by one of the general formulae (7) to (12) provides less sensitivity change from Developer 1 to Developer 2 and improvements in stability to prolonged storage.

EXAMPLE 6

Emulsions were prepared in the same manner as in Emulsion A of Example 1, except that to an emulsion comprising Sensitizing Dye 1-Q of the present invention in an amount of $5\times10^{-4}$ mol per mol of silver were added compounds (7) to (9) of the present invention set forth in Table 8 and then 5-chloro-8-hydroxyquinoline in an amount of $2\times10^{-3}$ mol per mol of silver, the compound having Structural Formula (a) in an amount of $3\times10^{-4}$ mol per mol of silver, Compound 4-1 as a hydrazine compound of the present invention in an amount of $4\times10^{-4}$ mol per mol of silver and Compounds (I) to (IV) of the present invention as nucleation accelerators in an amount of $1\times10^{-3}$ mol per mol of silver. The amount of the hydrazine compound to be added was adjusted such that the sensitivity obtained with Developer 1 was almost the same as that obtained without a nucleation accelerator.

To the emulsion were then added the same components as in Example 1, beginning with N-oleyl-N-methyltaurine sodium and ending with the film hardener. The emulsion was then coated on a support. A protective layer was coated in the same manner as in Example except that the compounds represented by one of the general formulae (10) to (12) of the present invention were added as set forth in Table 8. A back layer and a back protective layer were coated in the same manner as in Example 1. Thus, specimens were prepared as set forth in Table 8.

These specimens were then evaluated in the same manner as in Example 1. The sensitivity was determined relative to that of Specimen 6-1 as 1. The results are set forth in Table 9.

TABLE 8

| | Compound (7)–(9) | | Compound (10)–(12) | | |
|---|---|---|---|---|---|
| Specimen No. | Kind | Added amount (mol/mol Ag) | Kind | Added amount (mg/m²) | Compounds (I)–(IV) |
| 6-1 | 7-11 | $3\times10^{-4}$ | — | — | I |
| 6-2 | 7-11 | $3\times10^{-4}$ | — | — | II |
| 6-3 | 7-11 | $3\times10^{-4}$ | — | — | III |
| 6-4 | 8-2 | $3\times10^{-4}$ | — | — | I |
| 6-5 | 8-2 | $3\times10^{-4}$ | — | — | II |
| 6-6 | 8-2 | $3\times10^{-4}$ | — | — | IV |
| 6-7 | 9-1 | $1.4\times10^{-2}$ | — | — | I |
| 6-8 | 9-1 | $1.4\times10^{-2}$ | — | — | III |
| 6-9 | 9-1 | $1.4\times10^{-2}$ | — | — | IV |
| 6-10 | — | — | T-1 | 5 | II |
| 6-11 | — | — | T-1 | 5 | III |
| 6-12 | — | — | T-1 | 5 | IV |
| 6-13 | 7-11 | $3\times10^{-4}$ | — | — | — |
| 6-14 | 8-2 | $3\times10^{-4}$ | — | — | — |
| 6-15 | 9-1 | $1.4\times10^{-2}$ | — | — | — |
| 6-16 | — | — | T-1 | 5 | — |

TABLE 9

| | Developer 1 | | Developer 2 | | Developer 3 | Prolonged storage stability | |
|---|---|---|---|---|---|---|---|
| Specimen No. | Sensitivity | γ | Sensitivity | γ | Black pepper | ΔlogE | Black Pepper |
| 6-1 | 1.00 | 19 | 0.96 | 18 | 4 | 0.07 | 4 |
| 6-2 | 1.02 | 19 | 0.98 | 18 | 3 | 0.07 | 3 |

TABLE 9-continued

| | Developer 1 | | Developer 2 | | Developer 3 | Prolonged storage stability | |
|---|---|---|---|---|---|---|---|
| Specimen No. | Sensitivity | γ | Sensitivity | γ | Black pepper | ΔlogE | Black Pepper |
| 6-3 | 1.00 | 19 | 0.96 | 18 | 4 | 0.07 | 3 |
| 6-4 | 0.95 | 19 | 0.90 | 17 | 4 | 0.08 | 3 |
| 6-5 | 0.95 | 19 | 0.91 | 18 | 4 | 0.07 | 4 |
| 6-6 | 0.95 | 19 | 0.90 | 17 | 3 | 0.08 | 3 |
| 6-7 | 1.00 | 19 | 0.95 | 17 | 4 | 0.07 | 4 |
| 6-8 | 1.00 | 19 | 0.95 | 17 | 4 | 0.07 | 4 |
| 6-9 | 0.98 | 19 | 0.94 | 18 | 4 | 0.07 | 3 |
| 6-10 | 0.97 | 19 | 0.93 | 17 | 4 | 0.08 | 4 |
| 6-11 | 0.97 | 19 | 0.92 | 17 | 4 | 0.07 | 4 |
| 6-12 | 0.98 | 19 | 0.93 | 17 | 4 | 0.08 | 3 |
| 6-13 | 1.00 | 19 | 0.92 | 17 | 4 | 0.07 | 4 |
| 6-14 | 0.95 | 19 | 0.86 | 17 | 4 | 0.08 | 4 |
| 6-15 | 1.00 | 19 | 0.90 | 17 | 4 | 0.07 | 4 |
| 6-16 | 0.97 | 19 | 0.89 | 17 | 4 | 0.08 | 4 |

Table 9 shows that the specimens comprising Compounds (I) to (IV) as nucleation accelerators exhibit further improvement in the change in sensitivity and γ value from Developer 1 to Developer 2.

EXAMPLE 7

Specimens 7-1 to 7-16 were prepared in the same manner as in Example 5, except that a sensitizing dye 3-U, a hydrazine compound 5-9 in an amount of $2\times10^{-4}$ mol/mol Ag, and nucleating promoting agents represented by general formulae (7) to (12) were used instead of the sensitizing dye 1-Q, the hydrazine compound 4-1, and neucleation agents represented by general formula (I), respectively. These specimens were evaluated in the same manner as disclosed in Example 1. The sensitivity was determined relative to that of Specimen 7-1 as 1. The results are shown in Table 10, below.

As seen from the results in Table 10, the specimens according to the present invention in which neucleating promoting agents represented by formulae (7) to (12) show excellent results in sensitivity change and stability to prolonged storage.

TABLE 10

| | Developer 1 | | Developer 2 | | Developer 3 | Stability to Prolonged Storage | |
|---|---|---|---|---|---|---|---|
| Specimen No. | Sensitivity | γ | Sensitivity | γ | Black pepper | ΔlogE | Black Pepper |
| 7-1 | 1.00 | 16 | 0.85 | 10 | 3 | 0.18 | 1 |
| 7-2 | 1.00 | 16 | 0.94 | 14 | 5 | 0.08 | 4 |
| 7-3 | 0.96 | 16 | 0.90 | 14 | 5 | 0.08 | 4 |
| 7-4 | 1.00 | 16 | 0.94 | 14 | 5 | 0.08 | 4 |
| 7-5 | 0.96 | 16 | 0.90 | 14 | 5 | 0.08 | 4 |
| 7-6 | 0.98 | 16 | 0.94 | 14 | 5 | 0.06 | 4 |
| 7-7 | 1.00 | 16 | 0.96 | 14 | 5 | 0.05 | 4 |
| 7-8 | 0.97 | 16 | 0.93 | 14 | 5 | 0.05 | 4 |
| 7-9 | 0.97 | 17 | 0.92 | 14 | 5 | 0.05 | 4 |
| 7-10 | 0.94 | 16 | 0.90 | 14 | 5 | 0.06 | 4 |
| 7-11 | 0.96 | 16 | 0.92 | 14 | 5 | 0.05 | 4 |
| 7-12 | 0.97 | 16 | 0.94 | 15 | 5 | 0.04 | 5 |
| 7-13 | 0.94 | 17 | 0.90 | 16 | 5 | 0.03 | 5 |
| 7-14 | 0.95 | 16 | 0.92 | 15 | 5 | 0.04 | 4 |
| 7-15 | 0.93 | 17 | 0.90 | 16 | 5 | 0.04 | 5 |
| 7-16 | 0.92 | 17 | 0.91 | 16 | 5 | 0.02 | 5 |

EXAMPLE 8

Developer 4

Concentrated solution:

| | |
|---|---|
| Sodium metabisulfite | 145 g |
| 45% Potassium hydroxide | 178 g |
| Pentasodium diethylenetriaminepenta-acetate | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium carbonate | 120 g |
| Water to make | 1 l |

The concentrated solution was diluted with water in a proportion of 1 to 2 to prepare Developer 4 having apE value of 10.5.

The specimens prepared in Examples 1 to 7 were evaluated in the same manner as in these examples, except that they were processed with Developer 4 instead of Developer 1. The specimens of the present invention exhibited excellent properties such as sensitivity, γ, black pepper and stability to prolonged storage.

While the invention has been described in detail and with reference to specific embodiments thereof, it will be apparent to one skilled in the art that various changes and modifications can be made therein without departing from the spirit and scope thereof.

What is claimed is:

1. A process for the formation of an image, which comprises development of a black and white photographic material which has been image wise exposed using a surface latent image silver halide with a developer having a pH value of 9.6 to less than 11.0, wherein the silver halide photographic material comprises at least one silver halide emulsion layer on a support, said silver halide emulsion layer comprising chemically sensitized silver halide grains having a silver chloride content of 50 mol % or more, said silver halide emulsion layer having been spectrally sensitized with at least one dye selected from the group consisting of the dyes represented by one of the following general formulae (1), (2) and (3), and said silver halide emulsion layer or at least one other hydrophilic colloid layer containing at least one member selected from the hydrazine derivatives represented by one of the following general formulae (4), (5) and (6) and at least one member selected from the group consisting of the compounds represented by one of the following general formulae (8), (9), (10), (11) and (12):

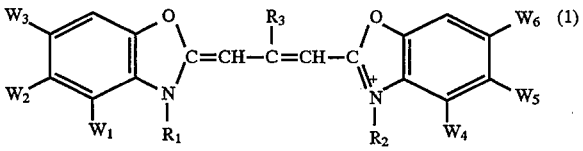

(1)

$(X_1)_{n1}$ wherein $W_1$ and $W_4$ each represents a mere bond or a hydrogen atom; $W_3$ and $W_6$ each represents a mere bond, a hydrogen atom, a methyl group or a methoxy group; $W_2$ represents an alkyl group having 1 to 6 carbon atoms, an alkoxy group having 1 to 5 carbon atoms, a bromine atom, an iodine atom or an aryl group having 1 to 9 carbon atoms or $W_2$ is connected to $W_1$ or $W_3$ when either is a mere bond to form a benzene ring, or $W_2$ represents a chlorine atom if $W_3$ represents a methyl or methoxy group; $W_5$ represents an alkyl group having 1 to 6 carbon atoms, an alkoxy group having 1 to 5 carbon atoms, a halogen atom, a hydroxyl group, an aryl group having 1 to 9 carbon atoms, an aryloxy group having 1 to 9 carbon atoms, an arylthio group having 1 to 8 carbon atoms, an alkylthio group having 1 to 4 carbon atoms or an acylamino group having 1 to 4 carbon atoms or $W_5$ is connected to W4 or $W_5$ when either is a mere bond to form a benzene ring; $R_1$ and $R_2$, which are the same or different, each represents an alkyl or alkenyl group having 1 to 10 carbon atoms; at least one of $R_1$ and $R_2$ is a group containing a sulfo or carboxyl group; $R_3$ represents a lower alkyl group; $X_1$ represents a paired ion necessary for the neutralization of electric charge; and $n_1$ represents an integer 0 or 1, with the proviso that if the compound represented by the general formula (1) is an intramolecular salt, $n_1$ is 0;

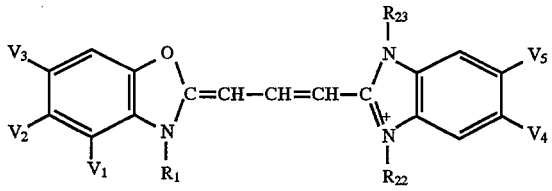

(2)

$(X_{21})_{n21}$ wherein $V_1$ represents a mere bond or a hydrogen atom; $V_2$ represents a hydrogen atom, a halogen atom, a hydroxyl group, an alkyl group having 1 to 6 carbon atoms, an alkoxy group having 1 to 5 carbon atoms, an aryl group having 1 to 9 carbon atoms, an aryloxy group having 1 to 9 carbon atoms, an arylthio group having 1 to 8 carbon atoms, an alkylthio group having 1 to 4 carbon atoms or an acylamino group having 1 to 4 carbon atoms or $V_2$ is connected to $V_1$ or $V_3$ when either is a mere bond to form a benzene ring; $V_3$ represents a mere bond, a hydrogen atom, a methyl group or a methoxy group; $V_4$ represents an electron withdrawing group; $V_5$ represents a hydrogen atom, a fluorine atom, a chlorine atom or a bromine atom; $R_{21}$, $R_{22}$ and $R_{23}$, which are the same or different, each represents an alkyl or alkenyl group having 1 to 10 carbon atoms; at least one of $R_{21}$, $R_{22}$ and $R_{23}$ is a group containing a sulfo or carboxyl group; $X_{21}$ represents a paired ion necessary for neutralization of electric charge; and $n_{21}$ represents an integer 0 or 1, with the proviso that if the compound represented by general formula (2) is an intramolecular salt $n_{21}$ is 0;

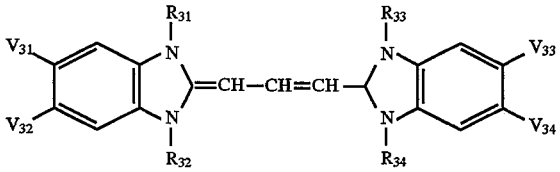

(3)

$(X_{31})_{n31}$ wherein $V_{31}$ and $V_{32}$ each represents a hydrogen atom or the same substituent groups represented by $V_4$; $V_{33}$ and $V_{34}$ are the same substituent groups represented by $V_4$; $R_{31}$, $R_{32}$ $R_{33}$ and $R_{34}$ may be the same or different and are the same substituent groups as those represented by $R_1$ and $R_2$, in which at least one of $R_{31}$, $R_{32}$, $R_{33}$, and $R_{34}$ represents a substituent having a sulfo group or a carboxyl group; $X_{31}$ represents an ion pair; and $n_{31}$ represents 0 or 1, with the proviso that if the compound represented by general formula (3) is an intramolecular salt, $n_{31}$ is 0;

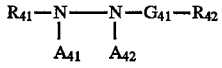

(4)

wherein $R_{41}$ represents an aliphatic or aromatic group containing as a partial structure $—O—(CH_2CH_2O)_n—$, $—O—(CH_2CH(CH_3)O)_n—$ or $—O—(CH_2CH(OH)CH_2O)_n—$, in which n represents an integer of 3 or more, or a group containing a quaternary ammonium cation; $G_{41}$ represents —CO—, —COCO—, —CS—, $—C(=NG_{42}R_{42})—$, —SO—, $—SO_2—$ or $—P(O)(G_{42}R_{42})—$; $G_{42}$ represents a single bond, —O—, —S— or $—N(R_{42})—$; $R_{42}$ represents an aliphatic group, aromatic group or hydrogen atom, with the proviso that if a plurality of $R_{42}$ groups is present in the molecule, they are the same or different; and one of $A_{41}$ and $A_{42}$ is a hydrogen atom and the other is a hydrogen atom, acyl group, alkyl group or arylsulfonyl group;

$R_{51}—NHNH—G_{51}—R_{52}$ (5)

wherein $R_{51}$ represents an aliphatic, aromatic or heterocyclic group; $G_{51}$ represents —CO—, —$SO_2$—, —SO—, —COCO—, thiocarbonyl group, iminomethylene group or —P(O)($R_{53}$)— in which $R_{53}$ represents a hydrogen atom, aliphatic group, aromatic group, alkoxy group, aryloxy group or amino group; and $R_{52}$ represents a substituted alkyl group in which a carbon atom bonded to $G_{51}$ is substituted by at least one electron withdrawing group;

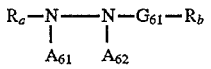

(6)

wherein $A_{61}$ and $A_{62}$ each represents a hydrogen atom or one of $A_{61}$ and $A_{62}$ represents a hydrogen atom and the other represents a sulfinic acid group or an acyl group; $R_a$ represents an aliphatic group, aromatic group or heterocyclic group; $R_b$ represents a hydrogen atom, alkyl group, aryl group, alkoxy group, aryloxy group or amino group; and $G_{61}$ represents a carbonyl group, sulfonyl group, sulfoxy group, phosphoryl group or iminomethylene group, with the proviso that at least one of $R_a$ and $R_b$ contains a group for accelerating adsorption of the hydrazine derivative to silver halide;

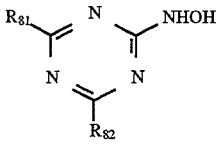

(8)

wherein $R_{81}$ and $R_{82}$, which are the same or different, each represents a hydroxyl, hydroxyalkyl, amino, alkylamino, arylamino, aralkylamino, alkoxy, phenoxy, alkyl, aryl, alkylthio or phenylthio group;

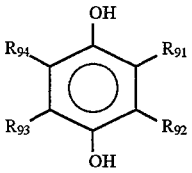

(9)

wherein $R_{91}$, $R_{92}$, $R_{93}$ and $R_{94}$ each represents a hydrogen atom, a hydroxyl group, an alkoxy group, an aryloxy group, an alkylthio group, an arylthio group, a halogen atom, a primary or secondary or tertiary amino group, a carbonamide group, a sulfonamide group, an alkyl group, an aryl group, a 5- or 6-membered heterocyclic group containing at least one nitrogen, oxygen or sulfur atom, a formyl group, a keto group, a sulfonyl group, a carboxyl group, an alkylsulfonyl group or an arylsulfonyl group;

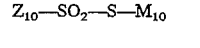

(10)

wherein $Z_{10}$ represents an alkyl, aryl or heterocyclic group; and $M_{10}$ represents a hydrogen atom, an alkali metal or an ammonium;

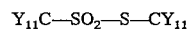

(11)

wherein $Y_{11}$ represents an atomic group necessary for the formation of an aromatic ring or heterocycle;

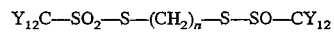

(12)

wherein $Y_{12}$ represents an atomic group necessary for formation of an aromatic ring or heterocycle; and n represents an integer of 2 to 10.

2. The process for formation of an image according to claim 1, wherein said silver halide emulsion layer or at least one other hydrophilic colloidal layer contains an amino compound as a nucleation accelerator.

3. The process for formation of an image according to claim 2, wherein said amino compound is a compound represented by one of the following general formulae (I) to (IV):

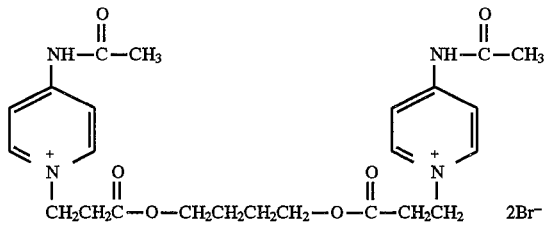

(I)

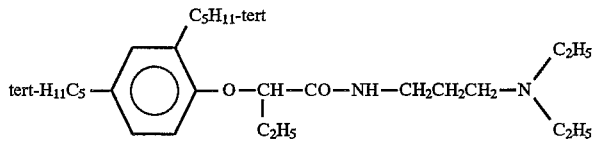

(II)

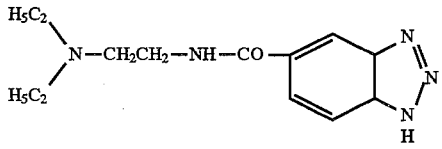

(III)

-continued

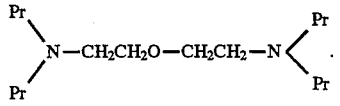

(IV)

4. The process for formation of an image according to claim 1, wherein the dye is according to general formula (1).

5. The process for formation of an image according to claim 1, wherein the dye is according to general formula (2).

6. The process for formation of an image according to claim 1, wherein the dye is according to formula (3).

7. The process for formation of an image according to claim 1, wherein the hydrazine derivative is according to formula (4).

8. The process for formation of an image according to claim 1, wherein the hydrazine derivative is according to formula (5).

9. The process for formation of an image according to claim 1, wherein the hydrazine derivative is according to formula (6).

10. The process for formation of an image according to claim 1, wherein said emulsion layer or at least one other hydrophilic colloid layer contains at least one member selected from the group consisting of the compounds represented by one of general formula (8).

* * * * *